US007106254B2

(12) United States Patent
Jouvie et al.

(10) Patent No.: US 7,106,254 B2
(45) Date of Patent: Sep. 12, 2006

(54) SINGLE-MODE ANTENNA ASSEMBLY

(75) Inventors: Francois Jouvie, Limours (FR); Alain Azoulay, Fontenay aux Roses (FR); Vikass Monebhurrun, Ste Genevieve des Bois (FR); Jacques Michelet, Claix (FR)

(73) Assignee: Hewlett-Packard Development Company, L.P., Houston, TX (US)

( * ) Notice: Subject to any disclaimer, the term of this patent is extended or adjusted under 35 U.S.C. 154(b) by 70 days.

(21) Appl. No.: 10/825,094

(22) Filed: Apr. 14, 2004

(65) Prior Publication Data

US 2005/0024267 A1 Feb. 3, 2005

(30) Foreign Application Priority Data

Apr. 15, 2003 (EP) ..... 03290938

(51) Int. Cl.
*H01Q 1/38* (2006.01)

(52) U.S. Cl. ..... 343/700 MS; 343/833; 343/834

(58) Field of Classification Search ..... 343/700 MS, 343/702, 846, 833, 834
See application file for complete search history.

(56) References Cited

U.S. PATENT DOCUMENTS

| | | | | |
|---|---|---|---|---|
| 2,505,751 | A | 5/1950 | Bolljahn | |
| 4,700,197 | A | 10/1987 | Milne | 343/837 |
| 4,864,320 | A | 9/1989 | Munson et al. | 343/833 |
| 5,389,937 | A | 2/1995 | Kaloi | 343/700 MS |
| 5,489,914 | A | 2/1996 | Breed | |
| 5,767,807 | A | 6/1998 | Pritchett | 342/374 |
| 5,959,586 | A | 9/1999 | Benham et al. | |
| 6,184,836 | B1 * | 2/2001 | Ali | 343/702 |
| 6,208,311 | B1 | 3/2001 | Reece et al. | 343/795 |
| 6,392,599 | B1 | 5/2002 | Ganeshmoorthy et al. | |
| 6,788,257 | B1 | 9/2004 | Fang et al. | 343/700 MS |
| 6,859,174 | B1 | 2/2005 | Kane et al. | 343/700 MS |
| 2005/0110692 | A1 * | 5/2005 | Andersson | 343/702 |

FOREIGN PATENT DOCUMENTS

| | | |
|---|---|---|
| EP | 0 829 110 B1 | 3/1998 |
| EP | 0 959 523 A1 | 11/1999 |
| EP | 1 189 305 A2 | 3/2002 |
| WO | 98/43313 | 10/1998 |

OTHER PUBLICATIONS

U.S. Appl. No. 10/825,081, filed Apr. 14, 2004, Monebhurrun et al.

(Continued)

*Primary Examiner*—Hoang V. Nguyen

(57) ABSTRACT

The invention provides for a planar antenna assembly supported on a substrate. The antenna includes a monopole element, at least one grounded parasitic element located proximate the monopole element, wherein each grounded parasitic element is grounded to a planar ground plane and incorporates a conductive profile shaped so that the separation between the parasitic element and the monopole adjacent it, varies along the length of the parasitic element. In one embodiment, the separation between the monopole and the parasitic element is provided by a stepped or angled edge on the or each grounded parasitic element, and the profile faces and extends away from monopole element. The antenna may include two grounded parasitic elements located on opposite sides of the monopole element and the, or each, grounded parasitic element may include a foot extending towards a base part of the monopole element which is adjacent the ground plane. The particular shape of the parasitic elements provides for good wideband performance and the antenna may find particular application in small or handheld devices where small form-factor antennas are required.

18 Claims, 21 Drawing Sheets

OTHER PUBLICATIONS

U.S. Appl. No. 10/825,093, filed Apr. 14, 2004, Jouvie et al.

Ali, M., et al., "Dual-Frequency Strip-Sleeve Monopole for Laptop Computers," *IEEE Transactions on Antennas and Propagation*, vol. 47, No. 2, pp. 317-323 (Feb. 1999).

Ali, M., et al., "A Dual-Frequency Strip-Sleeve Monopole Antenna for a Laptop Computer," *Antennas and Propagation Society International Symposium*, Atlanta, Georgia, pp. 794-797 (Jun. 21, 1998).

Lebbar, H., et al., "Analysis and Size Reduction of Various Printed Monopoles with Different Shapes," *Electronics Letters*, vol. 30, No. 21, pp. 1725-1726 (Oct. 13, 1994).

Lebbar, H., et al., "Analysis and Optimization of Reduced Size Printed Monopole," *Antennas and Propagation Society International Symposium*, New York, New York, pp. 1858-1861 (Jun. 28, 1993).

McLean, J., et al., "Broadband, Robust, Low-Profile Monopole Incorporating Top Loading, Dielectric Loading, and a Distributed Capacitive Feed Mechanisms," *Antennas and Propagation Society*, IEEE International Symposium, Orlando, Florida, pp. 1562-1565 (Jul. 11, 1999).

* cited by examiner

| Point | a1 | a2 | a3 | a4 | a5 | a6 | a7 | a8 | a9 |
|---|---|---|---|---|---|---|---|---|---|
| X | -16 | -2 | -2 | -6.5 | -6.5 | -8 | -11 | -11 | -12 |
| Y | 0 | 0 | 5 | 5 | 14 | 23 | 23 | 5 | 5 |

| Point | a10 | a11 | a12 | a13 |
|---|---|---|---|---|
| X | -12 | -14 | -14 | -16 |
| Y | 24 | 24 | 5 | 5 |

| Point | b1 | b2 | b3 | b4 | b5 | b6 | b7 | b8 | b9 |
|---|---|---|---|---|---|---|---|---|---|
| X | 16 | 2 | 2 | 6.5 | 6.5 | 8 | 11 | 11 | 12 |
| Y | 0 | 0 | 5 | 5 | 14 | 23 | 23 | 5 | 5 |

| Point | b10 | b11 | b12 | b13 |
|---|---|---|---|---|
| X | 12 | 14 | 14 | 16 |
| Y | 24 | 24 | 5 | 5 |

| Point | a1 | a2 | a3 | a4 | a5 | a6 | a7 | a8 | a9 | a10 | a11 |
|---|---|---|---|---|---|---|---|---|---|---|---|
| X | -11 | -2 | -2 | -5.5 | -5.5 | -8 | -11 | -11 | -8 | -8 | -11 |
| Y | 0 | 0 | 5 | 5 | 12 | 22 | 22 | 12 | 12 | 8 | 8 |

| Point | b1 | b2 | b3 | b4 | b5 | b6 | b7 | b8 | b9 | b10 | b11 |
|---|---|---|---|---|---|---|---|---|---|---|---|
| X | 11 | 2 | 2 | 5.5 | 5.5 | 8 | 11 | 11 | 8 | 8 | 11 |
| Y | 0 | 0 | 5 | 5 | 12 | 22 | 22 | 12 | 12 | 8 | 8 |

| Point | c1 | c2 | c3 | c4 |
|---|---|---|---|---|
| X | -1 | 1 | 1 | -1 |
| Y | 0 | 0 | 1 | 1 |

| Point | d1 | d2 | d3 | d4 | d5 | d6 | d7 | d8 |
|---|---|---|---|---|---|---|---|---|
| X | -1 | 1 | 1 | 2 | 2 | -2 | -2 | -1 |
| Y | 3 | 3 | 7 | 7 | 62 | 62 | 7 | 7 |

SCHEMATIC TEMPLATE OF ANTENNA#2

| Point | a1 | a2 | a3 | a4 | a5 | a6 | a7 | a8 | a9 |
|---|---|---|---|---|---|---|---|---|---|
| X | -8 | -2 | -2 | -5.5 | -4.5 | -8 | -13 | -13 | -8 |
| Y | 0 | 0 | 6 | 6 | 14 | 22 | 22 | 12 | 12 |

| Point | b1 | b2 | b3 | b4 | b5 | b6 | b7 | b8 | b9 |
|---|---|---|---|---|---|---|---|---|---|
| X | 8 | 2 | 2 | 5.5 | 3 | 8 | 13 | 13 | 8 |
| Y | 0 | 0 | 6 | 6 | 14 | 22 | 22 | 12 | 12 |

| Point | c1 | c2 | c3 | c4 |
|---|---|---|---|---|
| X | -1 | 1 | 1 | -1 |
| Y | 0 | 0 | 1 | 1 |

| Point | d1 | d2 | d3 | d4 | d5 | d6 | d7 | d8 | d9 | d10 | d11 | d12 |
|---|---|---|---|---|---|---|---|---|---|---|---|---|
| X | -1 | 1 | 1 | 2 | 1 | 2 | 2 | -2 | -2 | -3.5 | -2 | -1 |
| Y | 3 | 3 | 7 | 7 | 14 | 22 | 65 | 65 | 22 | 14 | 7 | 7 |

SINGLE-MODE ANTENNA ASSEMBLY

CROSS REFERENCE TO RELATED APPLICATIONS

The subject matter of the present application may also be related to the following U.S. patent applications: "Antenna Assembly," Ser. No. 10/825,081, filed Apr. 14, 2004; and "Dual-Access Monopole Antenna Assembly," Ser. No. 10/825,093, filed Apr. 14, 2004.

FIELD OF THE INVENTION

The present invention relates to multiple-access antenna assemblies. More particularly, although not exclusively, the invention relates to strip-based antenna designs which are particularly suitable for simultaneous scanning of a frequency spectrum composed of multiple service sub-bands. The antennas of the present invention are particularly suitable for, although not limited to, use in portable or mobile devices where access is required to services such as wireless LANs, GPS and the like.

BACKGROUND OF THE INVENTION

With the rapid increase in wireless communication, there is an increasing need for mobile devices, such as portable computers, laptops, palmtops, personal digital assistants and similar devices (hereinafter collectively referred to as mobile computing devices), to be able to communicate wirelessly with a variety of services. At the present time, a range of wireless services are in common use, for example wireless LANs, GSM, GPS and similar. These encompass communication services such as GSM or Bluetooth as well as geographical positioning systems such as GPS.

These different wireless communication systems, each with corresponding different operating frequencies, will continue to be used in the foreseeable future. With the convergence of device functionality, for example, a mobile phone integrated with a PDA, it is envisaged that such a single device would be capable of handling communications in respect of a variety of services.

The frequencies allocated to the different services reflect a number of factors including statutory allocation schemes, technical suitability to a specific type of task or historical precedent. It is envisaged that these plural communication systems will continue in existence given the advantages they offer in their own particular domains as well as for legacy reasons.

For devices requiring multiple-access, that is, the ability to simultaneously receive and transmit on different frequency bands, usually using different communication standards, it is necessary to provide an antenna assembly which provides such functionality.

Attempts have been made to design antenna assemblies for mobile computing devices which are able to operate at two different wireless communication frequencies. For example, M. Ali et al, in an article entitled "Dual-Frequency Strip-Sleeve Monopole for Laptop Computers", IEEE Transactions on Antennas and Propagation, Vol. 47, No. 2, February 1999, pp. 317–323, describes a monopole antenna design which can operate at two frequencies, namely between 0.824–0.894 GHz for the advanced mobile phone systems (AMPS) band and between 1.85–1.99 GHz for the personal communication systems (PCS) band. Ali et al describes the satisfactory operation of a strip-sleeve monopole antenna within these two frequency bands, including the possibility of omitting one of the two sleeves. A strip-sleeve antenna in this context corresponds to a single monopole with two parasitic antennas arranged on either side of the primary monopole, thus, when viewed from the side, constituting a sleeve arrangement. A three-dimensional analogue is a coaxial sleeve antenna. The system described by Ali et al is however limited to dual frequency applications over a fairly narrow range of frequencies.

Although several antenna solutions already exist in the market for the different wireless communication standards described below, they are generally individually expensive, particularly if it is desired to provide a plurality of antennae to be able to scan all of the communication bands which are accessible. These solutions are therefore not practicable and may further suffer from the drawback that when located in the same device, each may interfere with the others operation.

SUMMARY OF THE PRESENT INVENTION

The present invention seeks to provide an improved antenna assembly, preferably for multi-band wireless communication.

In one aspect the invention provides for a planar antenna assembly supported on a substrate, said antenna including a monopole element, at least one grounded parasitic element located proximate the monopole element, wherein each grounded parasitic element is grounded to a planar ground plane and incorporates a conductive profile shaped so that the separation between the parasitic element and the monopole adjacent it, varies along the length of the parasitic element.

The separation between the monopole and the parasitic element is preferably provided by a stepped or angled edge on the or each grounded parasitic element, wherein the profile faces and extends away from monopole element.

Preferably, the assembly includes two grounded parasitic elements located on opposite sides of the monopole element.

Preferably the or each grounded parasitic element includes a foot extending towards a base part of the monopole element which is adjacent the ground plane.

The base part of the monopole element may be of reduced width compared to the remainder thereof. The or each grounded element may include a recess in an outer edge thereof.

Each recess may have an upper wall proximate an end of the conductive profile. Each recess may extend to a base of the grounded element.

Each conductive profile preferably includes two stepped or angled surfaces extending away from the monopole element, with an apex between the two stepped or angled surfaces pointing towards the monopole element.

The lower portion of the monopole element is preferably of meandering form.

In the preferred embodiments, the monopole element is tuned to operate in a frequency band of substantially 880 MHz to 2,500 MHz, to operate in the GSM to Bluetooth/IEEE 802.11b bands.

Advantageously, the assembly is substantially flat.

In an embodiment, there is provided a conductive element on the substrate and not in electrical contact with the parasitic elements of the first monopole element.

The embodiments of antenna assembly disclosed herein are able to provide communication through a wide band, typically from 900 MHz to 2,500 MHz, and therefore are able to scan all of the existing communication bands currently being used and which are likely to be used in the future for such communication standards. It is not necessary to provide many different antennae to be able to achieve this and therefore the preferred embodiments benefit form being implementable at low cost and can be small enough to be embedded into a portable computing device. It is thus preferred that the antennae are small enough, either to be integrated into a laptop computer or to be easily connected as an attachment to device.

It is envisaged in some embodiments that while several receivers could operate at the same time in the listening mode, only one single transmitter would transmit data at any given time. Preferably, the antenna assembly is arranged to connect permanently to the band most used by the mobile computing device (at present the 2.5 GHz band for Bluetooth or IEEE 802.11b) and to scan the other bands.

DESCRIPTION OF THE DRAWINGS

Embodiments of the present invention are described below, by way of example only, with reference to the accompanying drawings, in which.

DESCRIPTION OF THE PREFERRED EMBODIMENTS

Preliminary Considerations

Figure 1:
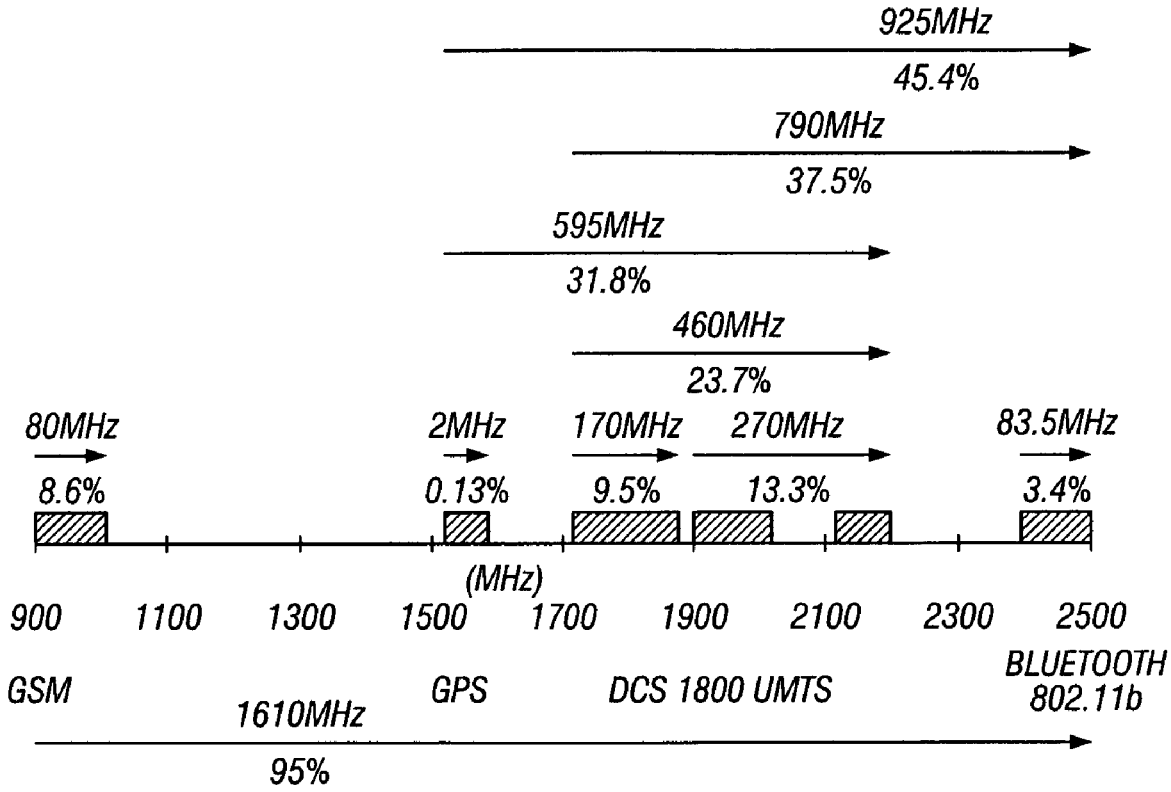
FIG. 1: shows schematically the frequency composition of the spectrum in respect of the GSM, GPS, DCS 1800, UMTS and Bluetooth services.

For a better understanding of the features and parameters of the described embodiments of the invention, the following detailed explanation of the problems and issues to overcome is as follows.

The specific embodiments of the invention described herein provide general purpose metallic strip-based antennae or antenna assemblies which are able to cover all (or at least a large proportion of) the wireless services which are presently available or expected to be used in Europe or USA in the foreseeable future.

The embodiments described herein are designed to be capable of covering the following wireless communication systems and frequencies for:

- GSM 900/1800 (GSM 1900 also for cases where UMTS compatibility is not required or when the compatibility problems with UMTS are resolved);
- IMT-2000 bands in all possible modes but more specifically oriented to UMTS; and
- ISM band wireless services such as Bluetooth or IEEE 802.11b.

Additionally, a number of the embodiments described herein are designed to include GPS frequencies.

The antenna geometries according to various aspects of the invention have been numerically modelled using known techniques for antenna characteristic modelling with which the skilled reader will be familiar. For brevity the modelling procedure will therefore not be discussed in detail.

Given the initial general overall structure of the innovative antenna structures disclosed herein, it is necessary to match the theoretical behaviour of the antennae with the expected spectrum composition. This allows fine tuning of the various antenna parameters as will be discussed below. The frequency bands allocated to the different services are explained as follows with reference to Table 1.

TABLE 1

| Service | Uplink (MHz) (Mobile transmits) | Output power | Downlink (MHz) (Mobile receives) | Sensitivity level | Comments | Reference |
|---|---|---|---|---|---|---|
| GSM 900 | 890–915 | 33 dBm ± 2.5 dB | 935–960 MHz | −102/−104 dBm (voice) | (1) | [ETSI ETS] |
| GPS single frequency | | | 1575.42 MHz | | (2) | [EUROCONTROL] |
| GSM 1800 | 1710–1785 | 30 dBm ± 2.5 dB | 1805–1880 | −100/−102 dBm (voice) | | [ETSI ETS] |
| UMTS TDD | 1900–1920 2010–2025 | | 1900–1920 2010–2025 | −105 dBm/ 3.84 MHz or −108 dBm/ 1.28 MHZ | | [3GPP TS 25.02] |
| UMTS FDD | 1920–1980 | 23 dBm + 1/−3 dB | 2110–2170 | −106 dBm/ 3.84 MHz | | [3GPP TS 25.01] |
| Bluetooth version 1.0B | 2400–2483.5 | Max 20 dBm Typical 0 to 10 dBm | 2400–2483.5 | −70 dBm @ BER = 1E−3 | | [BLUETOOTH] |
| IEEE 802.11b | 2400–2483.5 | Max 20 dBm Typical 0 to 10 dBm | 2400–2483.5 | −75/−80 dBm @BER = 1E−4 | | [IEEE 802.11] |

(1) It is noted that there is a possibility that the GSM band (E-GSM) may be extended. This could add 10 MHz in the lower part of the GSM 900 band on both links. E-GSM should have 880–915 MHz as uplink and 925–960 as downlink.

(2) GPS is a receive-only position localisation system based on concurrent reception of synchronised signals from a plurality of satellites. Thus the antenna should be able to 'view' the sky and the high receiver sensitivity should not be impaired by the other systems implemented in the vicinity. Additionally, the antenna polarisation should be also specifically considered. For GPS, it is a right-hand circular polarisation (RHCP). The reception frequency is 1575.42 MHz and the receiving bandwidth is 2 MHz (20 MHz.

(3) Cellular phone services use generally two frequency bands, one for the uplink and one for the downlink. In the uplink, the mobile device transmits and the base station receives, whereas in the downlink the base station transmits and the mobile device receives.

(4) Wireless local area networks (LANs) operate differently, because in general only one frequency is used. Both the mobile and fixed access points transmit and receive at the same frequency using a time-sharing scheme.

Table 1 shows that a multiple-access antenna assembly for the services listed in Table 1 should desirably cover a relatively wide range of frequencies, extending roughly from 880 to 2500 MHz. Although possibly depending on the service requirements, the transmitting power in any particular band should not impair the antenna reception in any receiving band. That is, in effect, it is desirable for each communication channel of a multiple-access to antenna behave as if it were completely independent of any neighbouring antenna structure in terms of simultaneous data transmission/reception. Physically, this corresponds to avoiding general electromagnetic interference effects such as parasitic effects caused by proximate conductors and sub-antenna interactions.

The problem may be more fully appreciated when it is realised that the frequency domain covered by services extending from GSM band to the Bluetooth band has a spectrum of almost three octaves and a total width of 1610 MHz. This total range of frequencies is very large both in terms of antenna technology as well as in the context of attempting to provide a compact antenna structure capable of multiple-access communication.

A second feature of the usage spectrum is that it is not continuous throughout the band but it is composed of several discrete and limited sub-bands. To this end, FIG. 1 shows the specific spectrum composition with particular services represented as rectangles covering corresponding frequency sub-bands. The spectrum usage is not homogeneous over the available frequency range. This excludes the use of devices operating by means of simple successive harmonic modes. Further, each standard may be itself subdivided for specific operating protocols.

FIG. 1 can be used to visualise the characteristics or the shape of the return loss curve correspondingly exhibited by an antenna which is to be used with this spectrum usage regime.

The return loss is essentially the same as the Voltage Standing Wave Ratio (VSWR) and provides a measure of the impedance mismatch between the transmission line and its load. Referring to FIG. 1, the antenna array as a whole should ideally exhibit a higher return loss in frequency bands where communication is to occur. Thus, working from left to right, an ideal return loss curve would have a peak at around 800 MHz (GSM), a peak centered on about 1,600 MHz (GPS) followed by a broad peak from 1,700 MHz to 1,850 Mhz (DCS 1800/UMTS) with a narrower isolated peak at around 2,150 MHz with a peak at around 2,500 MHz (Bluetooth 802.11b). This general shape can be seen in FIG. 16 and others and will be discussed further below.

In accordance with these embodiments of the present invention, there is provided a multi-access antenna with a plurality of antennas in a hybrid form, with a single antenna per standard or with antennas combining the ability to transmit and receive at several standards. To aid in visualising which frequency bands may be combined and the consequences of the combinations for the antenna requirements, several combinations are shown in Table 2, indicating for each one of them the central frequency and the associated bandwidth.

TABLE 2

| Combinations of standards | fc (MHz)/BW (%) |
|---|---|
| GSM (alone) | 930/8.6% |
| DCS (alone) | 1795/9.5% |
| UMTS (alone) | 2035/13.3% |
| DCS + UMTS | 1940/23.7% |
| GPS + DCS + UMTS | 1872.5/31.8% |
| DCS + UMTS + Bluetooth | 2105/37.5% |
| GPS + DCS + UMTS + Bluetooth | 2037.5/45.4% |

It can be seen that, with the exception of the GPS standard, which is a particular case characterised by a very narrow bandwidth (0.13%), almost all the standards require bandwidths of about 10% when chosen individually and larger bandwidths when they are grouped.

In addition to bandwidth, the antenna design must consider the radiation of the antenna or antenna array as well as geometrical size and impedance matching issues.

Figure 2:
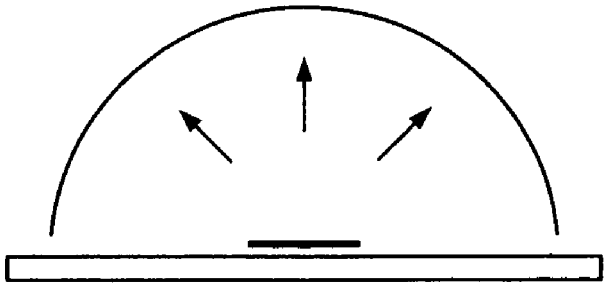
FIG. 2: shows an omnidirectional radiation pattern of an antenna.

Considering that any mobile communication device is likely to be used in a virtually infinte number of positions and orientations, an omnidirectional radiation pattern is the most desirable (such as the one shown schematically in FIG. 2).

This kind of pattern is likely to be convenient for all applications. Nevertheless, for all the standards, with the exception of GPS, antennas that do not radiate in the broadside direction (towards the zenith) can be accepted because the operating signals seldom come uniquely from above (azimuthal pattern, shown schematically in FIG. 3).

Figure 3:
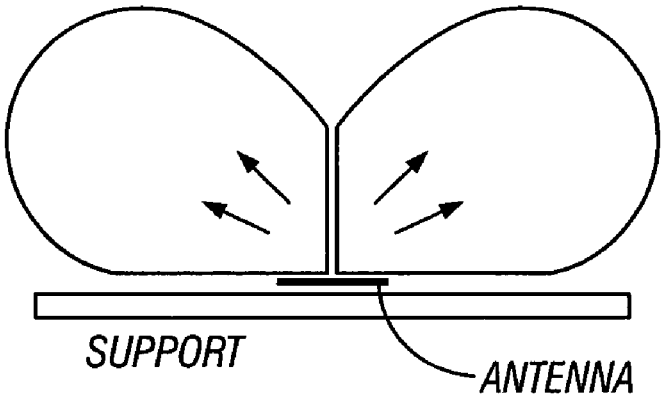
FIG. 3 shows an azimuthal radiation pattern of an antenna.
Figure 4:
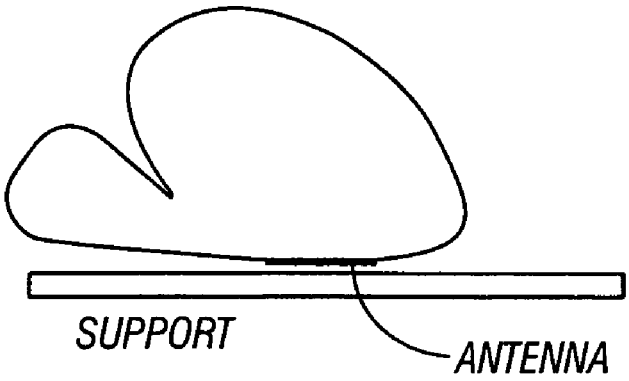
FIG. 4: shows an antenna radiation pattern having an arbitrary null.

FIG. 4 shows an intermediate state which shows the case where a quasi-omnidirectional pattern contains a radiation null in an arbitrary direction. Here, the specific feature of this case, compared to the pattern of FIG. 3, is that the direction of the null cannot be easily predicted. This situation is often encountered with asymmetrically fed antennas or when higher-order modes are excited on the radiating structure instead of the fundamental one. If this null cannot be eliminated, its effect can be practically circumvented by the user, by changing the orientation of the antenna slightly.

It is also desirable to consider the geometrical lengths characterising each frequency band in the spectrum. To this end, an antennas electrical dimensions must be proportional to the wavelength of the operation considered, with a typical radiating element dimension being a length of equal to a half or a quarter wavelength. Table 3 shows these dimensions for some frequencies selected in Table 2.

TABLE 3

| Frequency (MHz) | $_0$ - wavelength (cm) | $_0/2$ | $_0/4$ |
|---|---|---|---|
| 930 | 32.26 | 16.13 | 8.06 |
| 1575 | 19.05 | 9.52 | 4.76 |
| 1795 | 16.71 | 8.36 | 4.18 |
| 1872.5 | 16.2 | 8.01 | 4.00 |
| 1940 | 15.46 | 7.73 | 3.86 |
| 2035 | 14.74 | 7.37 | 3.69 |
| 2037.5 | 14.72 | 7.36 | 3.68 |
| 215 | 14.25 | 7.12 | 3.56 |
| 2450 | 12.24 | 6.12 | 3.06 |

Therefore, antenna systems which can provide a feasible solution in this frequency domain will have geometrical dimensions between at least a few centimetres and a few tens of centimetres, i.e.1 corresponding to a quarter wavelength resonance length. Substantial miniaturisation will not be practically possible due to the physical constraints in the size of the driven elements of the antenna. Moreover, in some implementations, the antenna device and support circuitry may be provided on a plug-in card such as a PCMCIA card inserted into the portable device. This further constrains the antenna arrangement to a specific degree of compactness. Thus, the geometry of the mobile device impose a real constraint on the acceptable size of the antenna. Other embodiments of antenna design may be practical in the form of extendable elements which can be drawn out of the portable device prior to use. Further variants may be embedded in a flat panel in the device or located behind the screen of the device such as in the screen of a laptop computer. As the antenna and the ground plane (usually a conductive sheet in the casing of the device) are in the same plane, the complete antenna arrangement can be advantageously embedded in the device in this case.

Thus the antennae embodiments of the invention described herein are of a type which can be built into various devices, such as laptop or handheld computers. To this end, the antenna assemblies are preferably produced in the form of metallic strip-based constructions. These can be fabricated on standard low cost epoxy substrates with negligible loss of performance. Such constructions have the advantages of low cost, low weight, portability, ease of implementation and are mechanically rigid.

The preferred embodiments described herein were designed so as to include the following features:

a) They include a permanent connection to a WLAN/Bluetooth 2.4–2.5 GHz band;

b) They make to use of a modified strip sleeve monopole for the antenna with two options, one having dual-access (one for the 2.4 GHz band, one for the cellular communication bands), the other single-access antenna covering all wireless services; and c) The VSWR of the antennas would be less than two, which corresponds to a return loss (S11) less than −9.5 dB in all the considered frequency bands and that the polarisation would be linear as far as possible.

On this basis, two initial related embodiments of the antennae are described as follows.

It is highly desirable to have a permanent reception mode active on the 2.45 GHz band (for IEEE 802.11b or Bluetooth) given that it is a passive reception (and triggered transmission) means of communication. This band is often used to provide networking facilities (i.e.; a wireless local area network WLAN), therefore the simplest solution is embodied by an antenna assembly with dedicated access to 2.45 GHz band and access to the other (cellular communications) bands by means of scanning. An alternative solution provides a wide band antenna covering every required frequency band but with a specific RF circuit management to provide the required frequency switching. This functionality can be provided by a mixture of hardware and software as described below.

However, a significant advantage of the dual-access antenna embodiments described herein is that they do not require signal separation circuitry/software. Further, since most local area network connection paradigms often require a permanent data connection to the service, one antenna can be devoted to the WLAN service while the second is used to scan the other services.

This latter multiple-access channel may involve multiple frequency reception/transmission which is governed by the specific antenna shape provided. To provide a solution to this requirement, a number of dual-access antenna designs are described below, together with embodiments of broadband antennae with single access operation.

Figure 5:
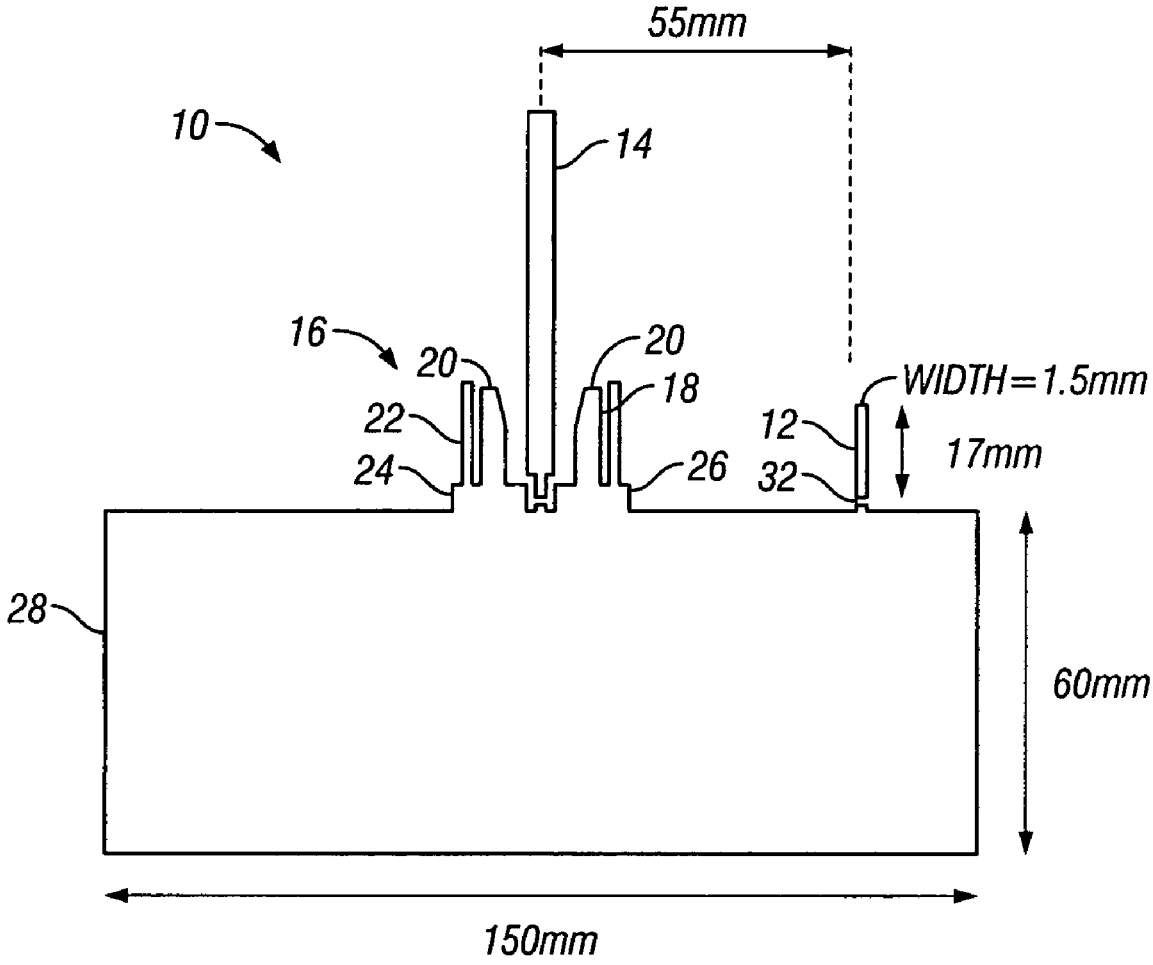
FIGS. 5, 6 and 7: show details of an embodiment of dual-access double-sleeve monopole-based antenna assembly.
Figure 6:
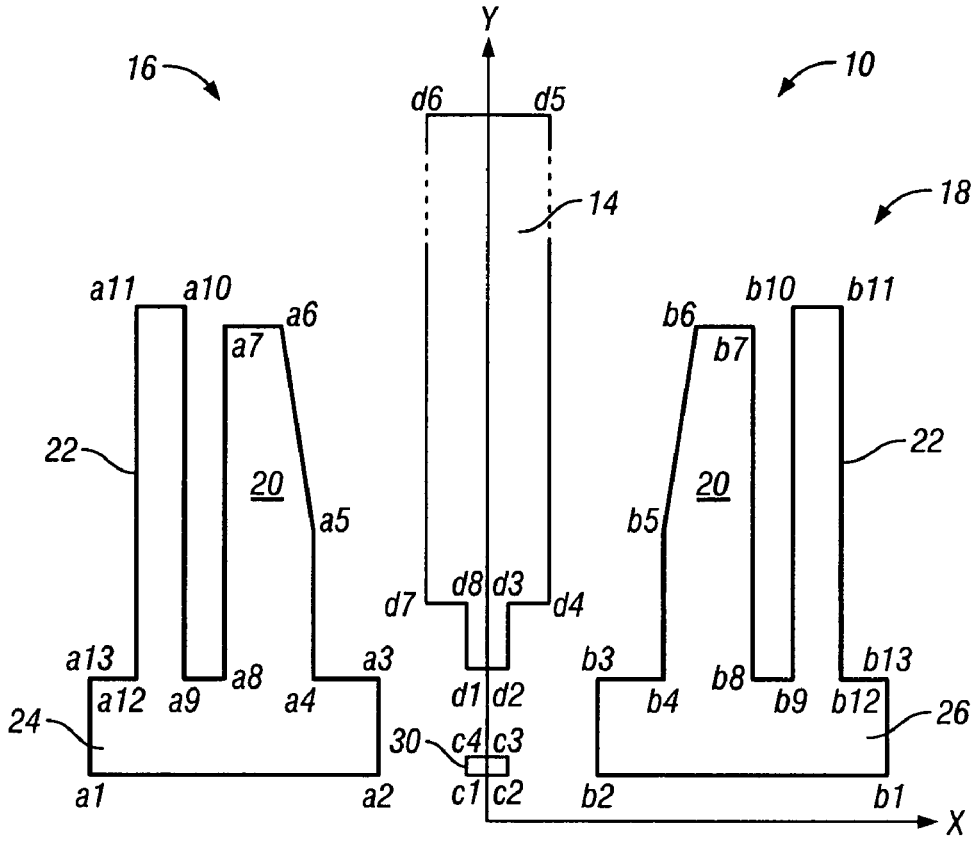
Figure 7:
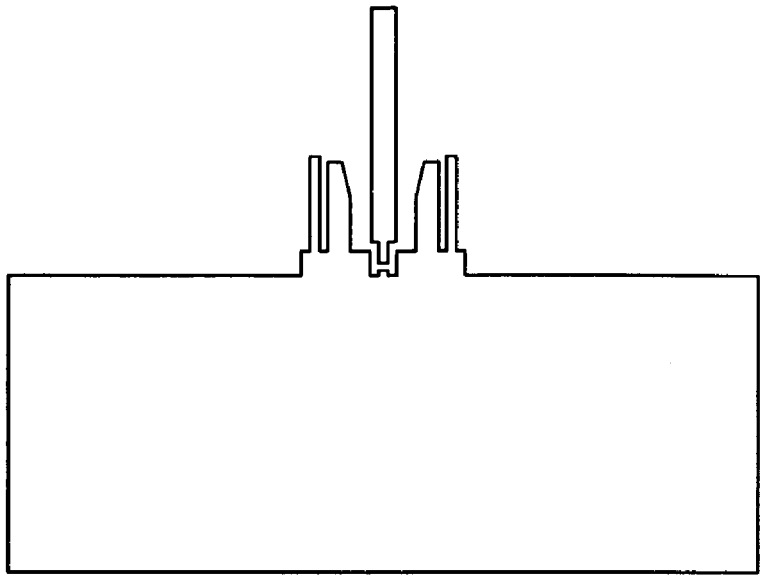

Referring to FIG. 5, there is shown a first example of antenna assembly which covers the various wireless mobile services in the 900 MHz to 2,500 MHz range. This and other figures in this description illustrate the copper-side plan of the of the antenna structure. FIGS. 6 and 7 show a single monopole dual-access antenna without the 2,500 MHz antenna indicated by 12 in FIG. 5. In this embodiment, the required operation is achieved by a dual access antenna assembly in which a first monopole antenna 10 is provided having an acceptable return loss (S11) in the GSM band and good S11 in all other bands. The frequency sub-band of 2.4 GHz–2.5 GHz (Bluetooth) is accessed using the secondary monopole antenna 12 placed alongside the antenna 10. The two antennae 10, 12 provide for simultaneous operation throughout the 900–2,500 MHz bands.

The antenna 10 is formed by a monopole element 14 surrounded by first and second grounded parasitic elements 16, 18 which together may be described as a "jaw". Each grounded element structure 16, 18 is provided with a first grounded element 20 having a stepped or angled surface extending away from the monopole 14 towards the free end of the element 20. Each structure 16, 18 also includes a second grounded element 22 spaced from the first element 20 and lying on the outside thereof relative to the monopole 14. This can be termed a "double-sheath" monopole structure.

The grounded element structures 16, 20 are located on respective bases or stubs 24, 26 extending from the ground plane 28. Between the bases 24, 26 there is provided a grounded drive element 30 (see FIG. 6), where the monopole 14 includes a narrowed stub reaching proximate the grounded element 30.

The entire antenna assembly 10, 12 and 28 is formed by etching or removing portions of the metallic surface from a dielectric substrate thereby forming the stripline antenna of the desired shape. To this end, in this and the following figures, the outline of the metallic portion is shown and the dielectric surface is omitted for clarity.

FIG. 6 shows a further embodiment of a preferred antenna geometry along with four tables containing the preferred dimensions for this embodiment of antenna structure 10 (all dimensions being in millimetres). Preferably, the dielectric substrate thickness is 16/10 mm and the height of the monopole 14, above the ground plane, is 71 mm. The ground plane 28, formed from any suitable metallic or metal material, is preferably 150 mm by 60 mm, with the monopole 14 centred thereon.

The antenna 12 is, in this embodiment, spaced from the monopole 14 by 55 mm, and has a height of 17 mm and a width of 1.5 mm. The separation distance between the monopole 14 and the antenna 10 is chosen so as to avoid mutual coupling between the two antennae and is determined by empirical measurements coupled with numerical modelling.

The two antennae 14 and 12 are driven by independent electronic circuits. To this end, the antenna 12 permanently scans its corresponding transmission band while the monopole 14 covers the other wireless bands. An example of circuit is described below.

Figure 8:
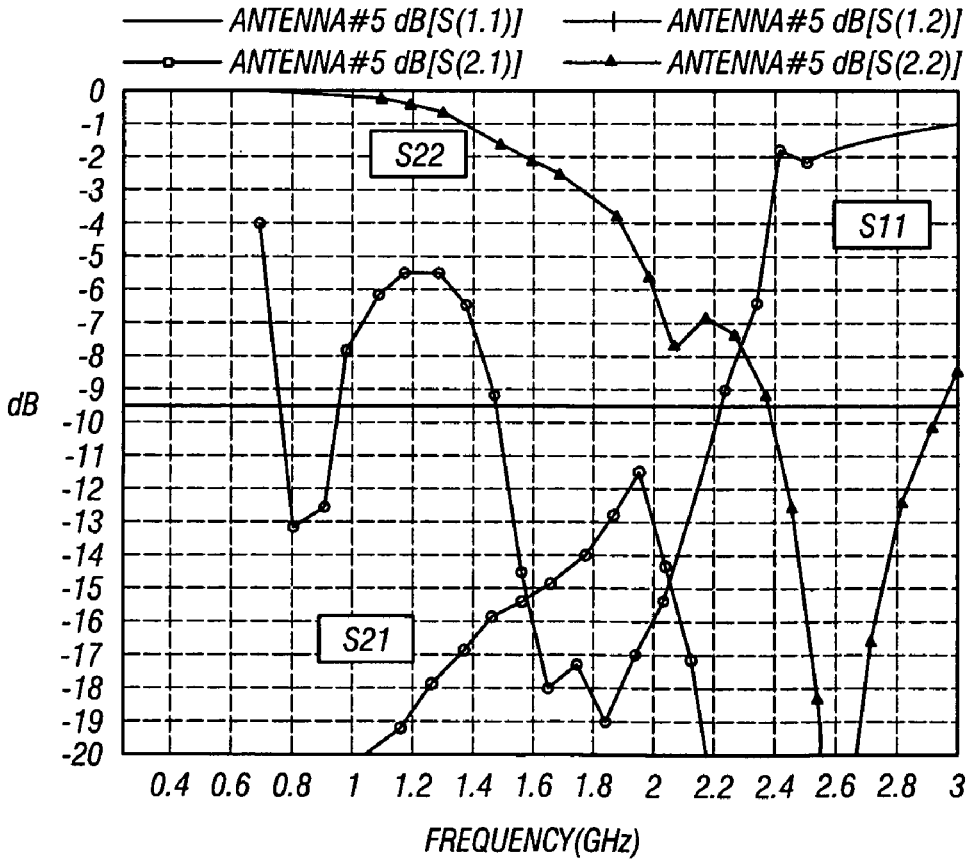
FIG. 8: is a graph showing the numerical results for the return loss for the antenna of FIGS. 5 and 6 for the GSM 900 band and for the DCS 1800 +UMTS band.

The numerical results obtained for the return loss (S11) coefficient for the monopole 14 (referenced at a 50 ohms characteristic impedance) are shown in FIG. 8. It can be seen that this monopole antenna 14 provides excellent transmission/reception characteristics at the two different chosen frequency bands (in this example GSM 900 and DCS 1800+UMTS).

Considering the performance of the entire assembly, that is, including the second monopole antenna 12 which is fed separately via its own physical port, the numerical results are as shown in FIG. 8 (again referenced at a 50 ohms characteristic impedance). In this example, the main monopole antenna 14 is fed by a first port and the second monopole 12 is fed by a second port.

It can be seen in FIG. 8 that the assembly 10, 12 provides for simultaneous communications in three wireless transmission bands for GSM 900, DCS 1800+UMTS and Bluetooth or IEEE 802.11b. As the second monopole 12 is both driven and physically separate from the first monopole 10, reception in the Bluetooth/IEEE 802.11b band is distinct and can be constantly active without interfering with the other wireless bands.

The characteristics of the particular embodiment of the antenna have been refined by comparing empirical measurements of the antenna characteristics with theoretical return loss profiles. Thus, the characteristics of this antenna structure can be varied by adjusting the angles of the angled surfaces of the two elements 16, 18, by adjusting the overall height of these elements and also by altering the positions, relative sizes and heights of the outlying element 22. It is believed that the angled grounded elements 16, 18 provide a form of waveguide which resonates at multiple frequencies, thereby providing the antenna with its highly desirable wideband operating characteristics.

Note should be made of the modification to this embodiment described below with reference to FIGS. 15 and 16.

Figure 9:
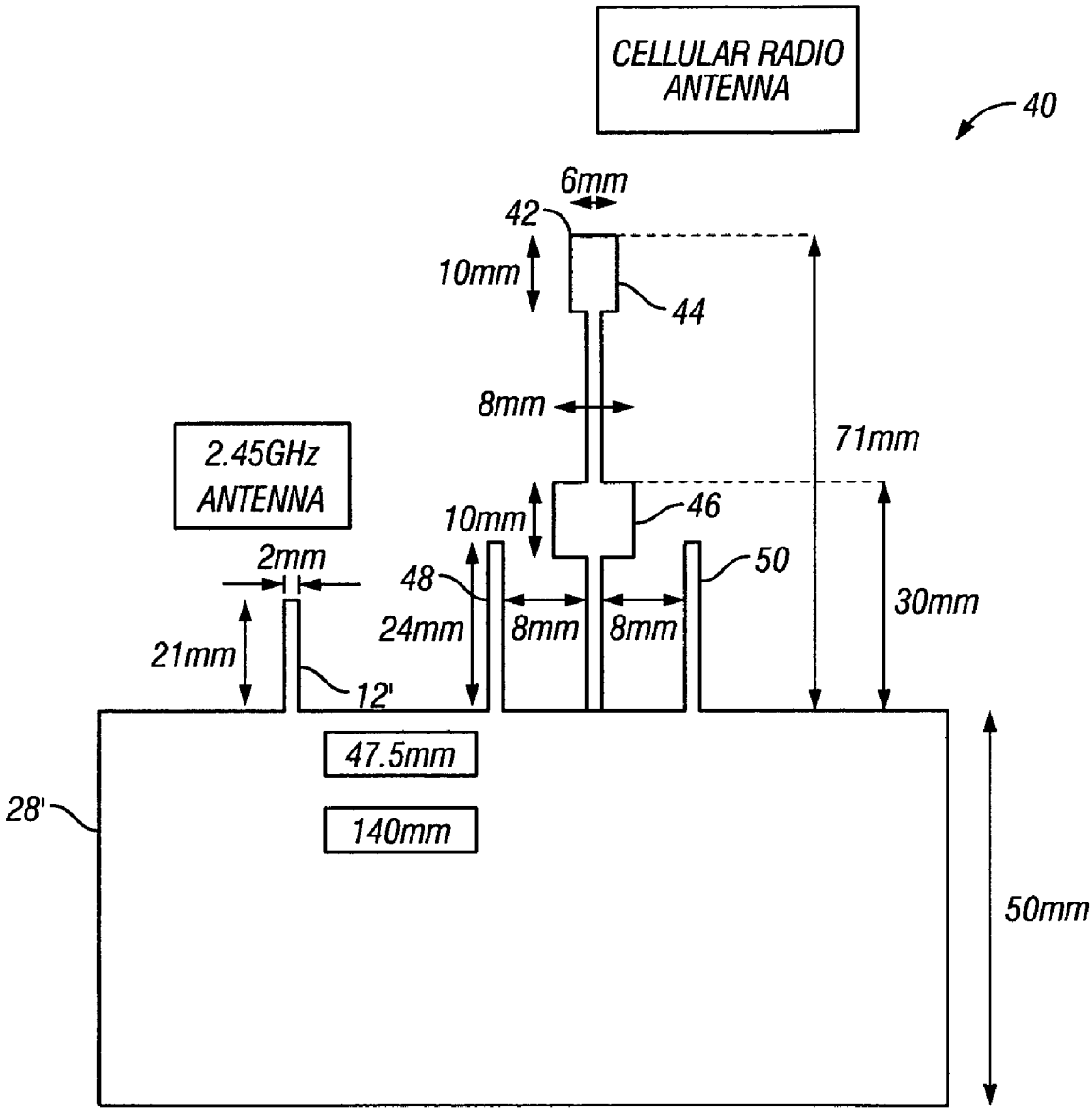
FIG. 9: shows another embodiment of dual-access monopole-based antenna assembly with a secondary antenna for Bluetooth access.

Referring now to FIG. 9, another embodiment of dual-access monopole-based antenna assembly in accordance with the invention is shown. This assembly also provides a separate monopole antenna 12' for the 2.45 GHz bands and a first monopole antenna 40 for the other wireless bands. As with the first described embodiment, the antennae according to this embodiment are formed by etching the copper side of a metal-coated dielectric or by depositing the metallic antenna elements onto a bare dielectric. The first monopole antenna 40 includes a monopole element 42 formed with two conductive planar "islands" 44, 46, the first 44 of which is located at the extremity of the antenna element 42, the second 46 of which is located in an intermediate position along the antenna element 42 and overlapping slightly two grounded elements 48, 50 lying either side of the monopole element 42. The monopole element 42 is insulated from the ground plane 28' and driven by a drive point on the dielectric (opposite) side of the planar assembly.

The effect of the islands 44, 46 are to modify the characteristics of the primary monopole antenna 42 such as to widen its cellular bandwidth. The island 46 functions in a manner similar to a coaxial sheath surrounding a linear wire antenna. Parasitic elements 48 and 50 are located at predetermined locations on either side of the primary monopole 40 and desirably function in a manner similar to those shown in FIG. 5.

The secondary monopole antenna 12' for the Bluetooth or IEEE 802.11b band is spaced from the main monopole by an specified distance in order to avoid mutual coupling between the two antennae 12', 42.

Again, this embodiment is designed so that the antenna 12' is permanently active to continuously scan the wireless local area network, while the primary antenna 42 covers the other wireless services.

FIG. 9 illustrates the dimensions of an exemplary embodiment of this antenna design. The dimensions shown are considered to be generally optimal in terms of providing the required return loss characteristics over the desired frequency spectrum usage composition. Variation of the position and geometry of the planar islands 44, 46 varies the width of the operating band of the antenna 40, as does the location and size of the parasitic elements 48, 50.

It has been found that this antenna has good matching performances in all cellular communications bands (with a return loss S11<−9 dB) and an overall gain of 0 dBi in the GSM bands. The 2.4–2.5 GHz band covered by the small antenna 12' has a very good matching (with a return loss S11<−15 dB) in that band. Tests with this antenna mounted on a Hewlett-Packard Jornada 720 handheld computer and on an Omnibook laptop computer showed very good reception levels in all of the dedicated bands, even for some for which the antenna assembly was not really intended for, particularly in the GPS and DAB bands.

As with both of the embodiments of FIGS. 5, 6 and 9, since the antenna elements and the ground plane are aligned in the same plane on a flat substrate, the antenna assemblies are well suited to being embedded in various devices such as laptop and handheld computers.

Figure 10:
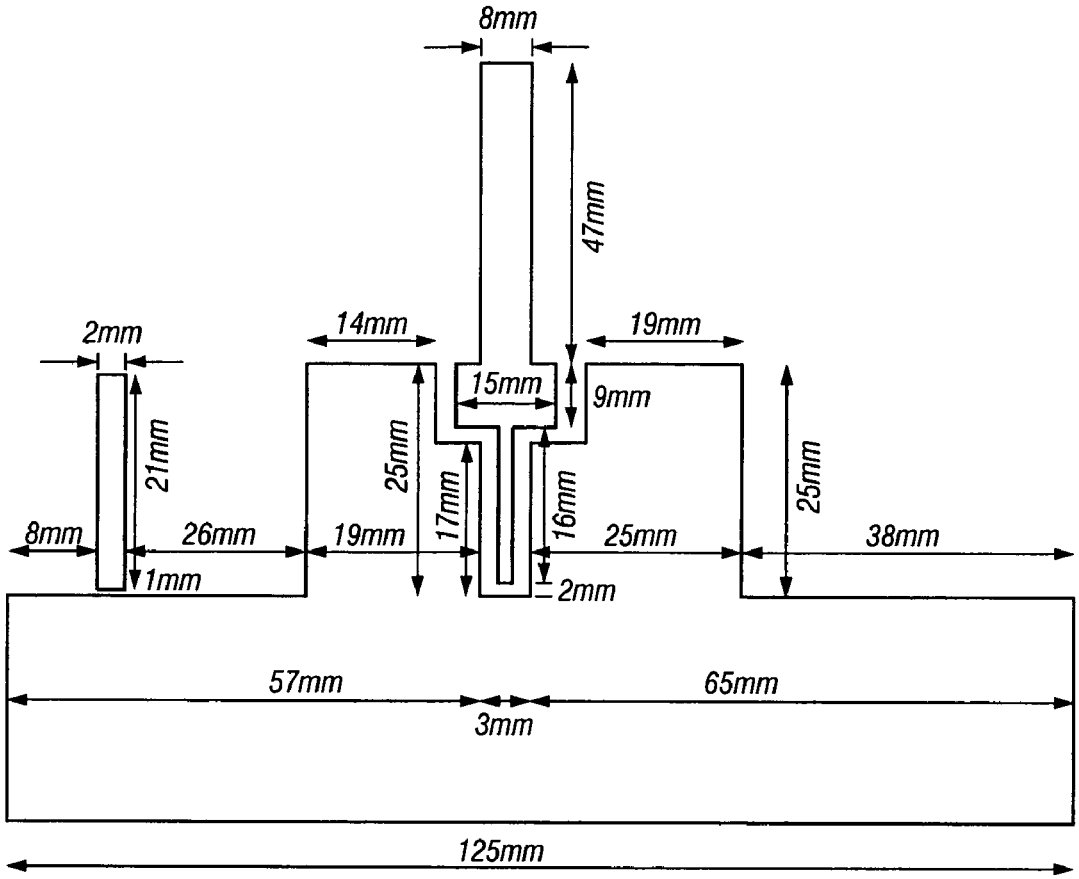
FIG. 10: shows a modification of the embodiment of FIG. 9.
Figure 11:
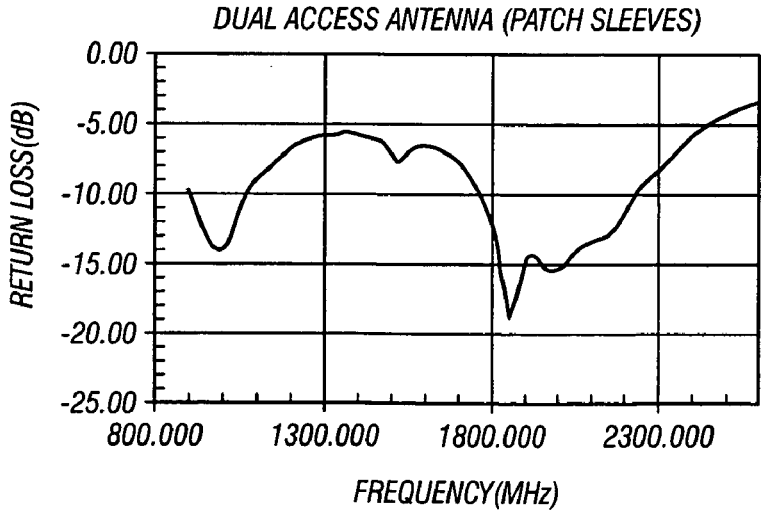
FIG. 11: is a graph showing the return loss for the modified antenna of FIG. 10.

Another version of the antenna embodiment of FIG. 9 includes modified single sleeves 48, 50 (see FIG. 10). These are in the form of patches 48', 50' the geometry of which have been found to widen the band and improve the global response of the dual access antenna as a whole. Such a modification in characteristics of the antenna arrangement has been achieved in tests but with an enlargement of the cellular communication antenna 42', as seen in FIG. 10. FIG. 11 shows the graph of return loss for this modification.

FIGS. 12 to 18 show further embodiments which can be used as wide band single access/single feed antennae covering the two frequency bands 890–960 MHz (GSM) and the 1710–2500 MHz (DCS, PCS, UMTS, IEEE 802.11b and Bluetooth). Again, these embodiments can be formed with their ground planes in the same plane so that the antenna structure can be embedded in a portable computing or information device.

The following embodiments are designed to cover all the above considered frequency bands from GSM to Bluetooth. Only one feed port is projected for each device.

If required, appropriate RF micro-switches and filters corresponding to the various wireless services bands can be connected in the form of an independent module with switching controlled by suitable firmware or software, of which examples are described below.

As noted above, to facilitate the integration of each antenna with its feed and matching microwave circuits, these three antennas are again designed according to a planar geometry, as with microstrip-line technology. Thus, the antennas are constituted by a conducting metallic forms (typically 35 μm in thickness) supported by a dielectric layer. For the three antenna embodiments described, the dielectric layer is a standard epoxy glass material. In the numerical simulations, the relative dielectric permittivity of the epoxy layer was estimated to be equal to 4.65 throughout the frequency band. Two different thicknesses of layers were tested, depending on the available industrial products: 8/10 mm and 16/10 mm. The RF drive points can be located via a microstrip line located on the opposite (dielectric) side of the substrate.

Specifically, the antennas are fed at the bottom of the monopole and a rectangular conducting patch 28 may be placed below the structure to function as a ground plane. For all the antennas, this ground plane has the dimensions of 60 mm×150 mm. Of course the particular dimensions of the ground plane may be varied depending on dimensions of the device, and the antenna it is to be used with.

The geometries of the parasitic jaws surrounding the central monopole and, possibly the meandering of the monopole itself, offer a number of parameters which can be adjusted to vary the operating characteristics of the antennae.

Figure 12:
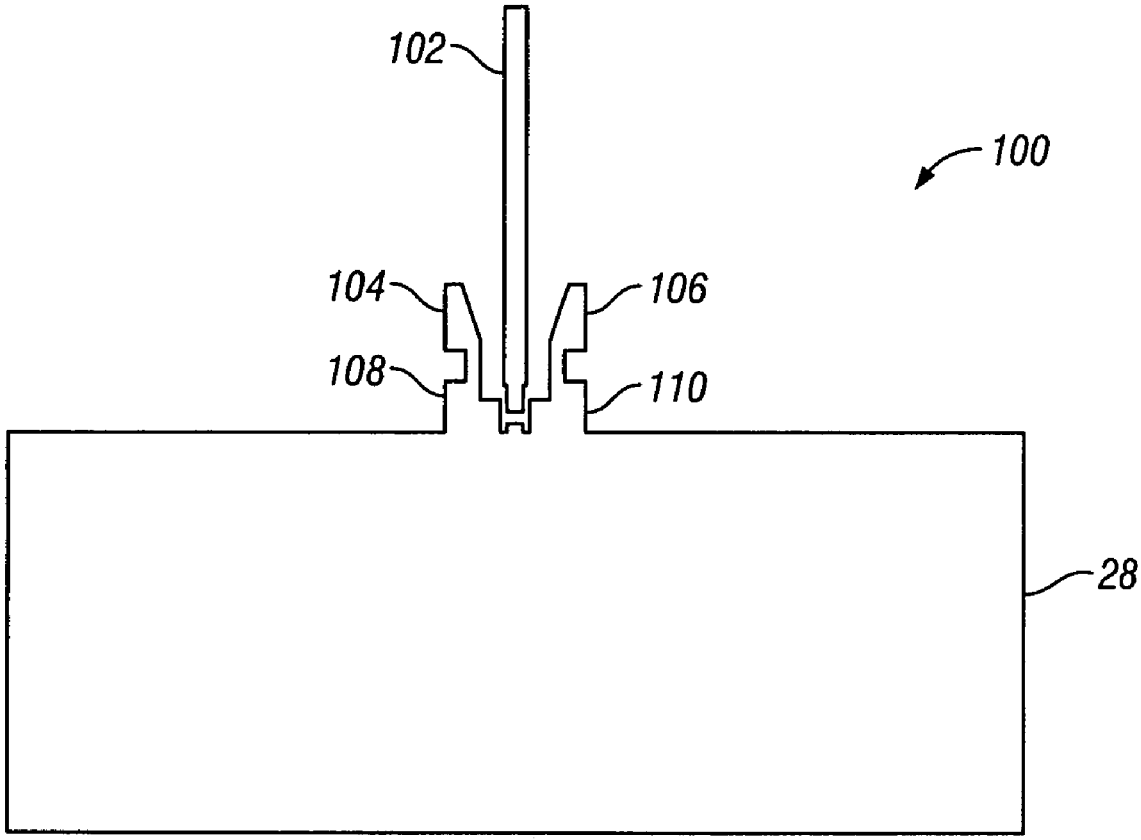
FIGS. 12 and 13: show an embodiment of a single-sleevewide band antenna structure including exemplary geometrical parameters.
Figure 13:
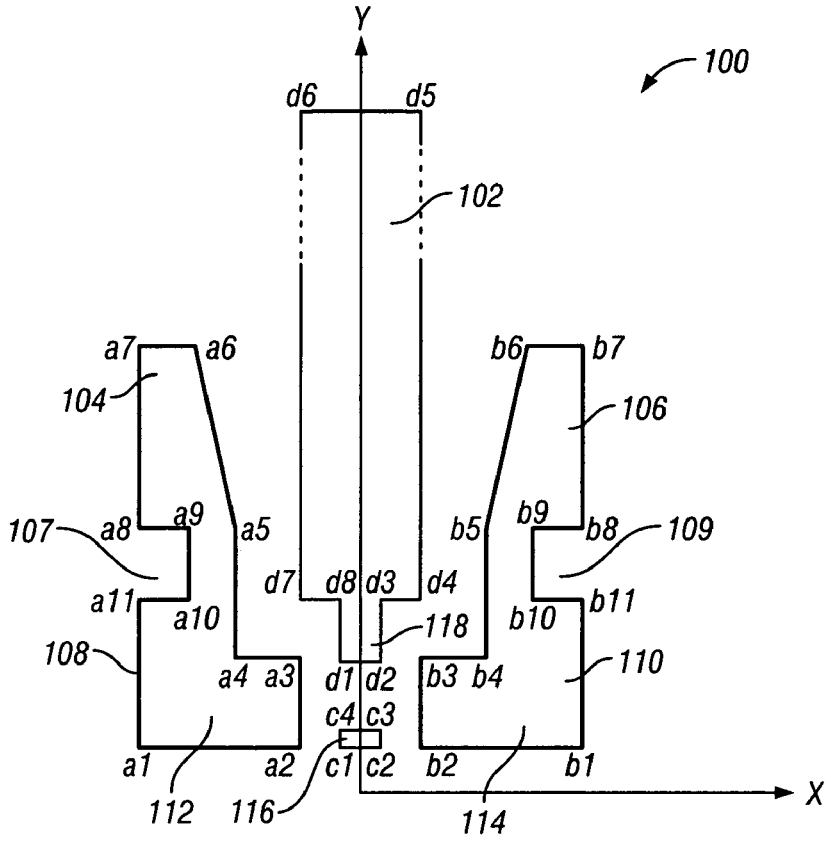

Referring to FIGS. 12 and 13, these show a first embodiment of wide band antenna structure 100 centred on a rectangular metallic ground plane 150 mm×60 mm.

The antenna 100 is formed by a suspended monopole element 102 surrounded by first and second grounded elements 104, 106 which together are described as "meandering jaws". Each grounded element 104, 106 is provided with a stepped or angled surface extending away from the monopole 102 towards the free end of the element 102. The outer face of each element 104, 106 is provided with a recess 107, 109 (see FIG. 18), the upper end of which is at substantially the same elevation as the base of the stepped or angled surface.

The grounded elements 104, 106 are located on respective bases 108, 110 extending from the ground plane 28 and which provide inwardly extending feet 112, 114 (see FIG. 13). Between the feet 112, 114 there is provided a grounded base 116 for the monopole 102, from which it is spaced as shown in FIGS. 12 and 13.

The monopole 102 is provided with a stepped lower portion 116 (see FIG. 13) which occupies the gap between the stubs or feet 112, 114.

FIG. 13 shows the preferred dimensions of the various portions of the antenna, in millimetres. The dielectric substrate thickness is preferably 16/10 mm and the height of the monopole, above the ground plane, is preferably 62 mm.

Figure 14:
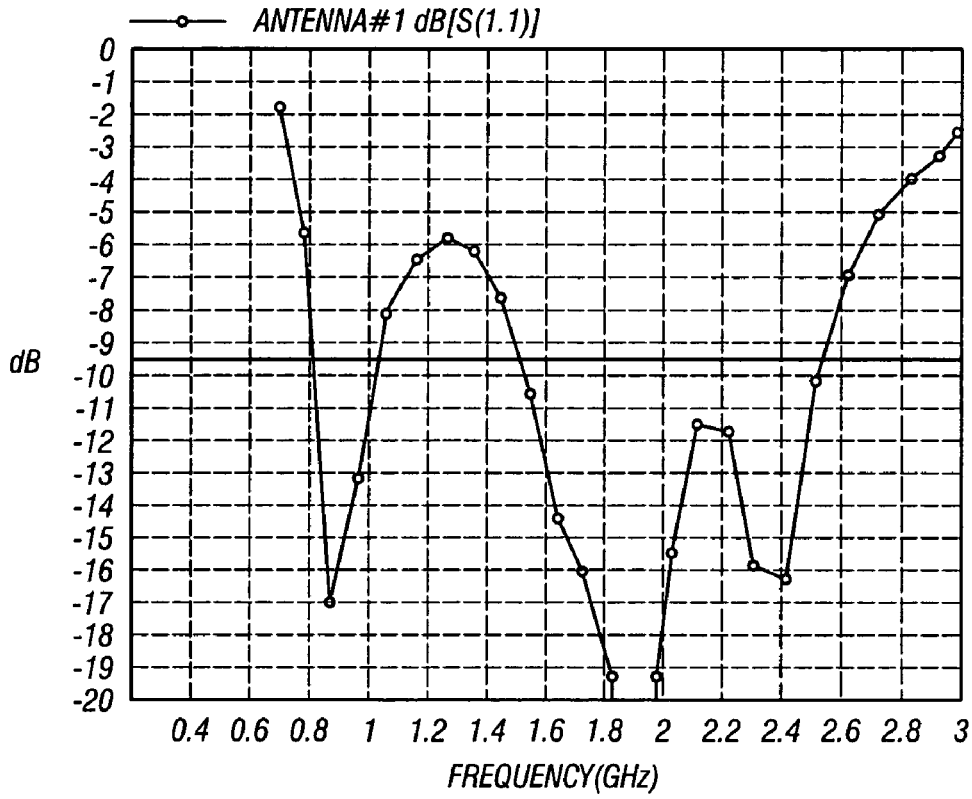
FIG. 14: shows a graph of the numerical results for return loss for the embodiment of antenna of FIGS. 12 and 13.

The numerical results obtained for the return loss (S11) coefficient of this antenna (referenced to a 50 ohms characteristic impedance) are shown in FIG. 14. As can be seen in FIG. 14, this structure of antenna provides good operation at the three frequency bands for GSM 900, GSM 1800+UMTS and Bluetooth/IEEE 802.11b.

Figure 15:
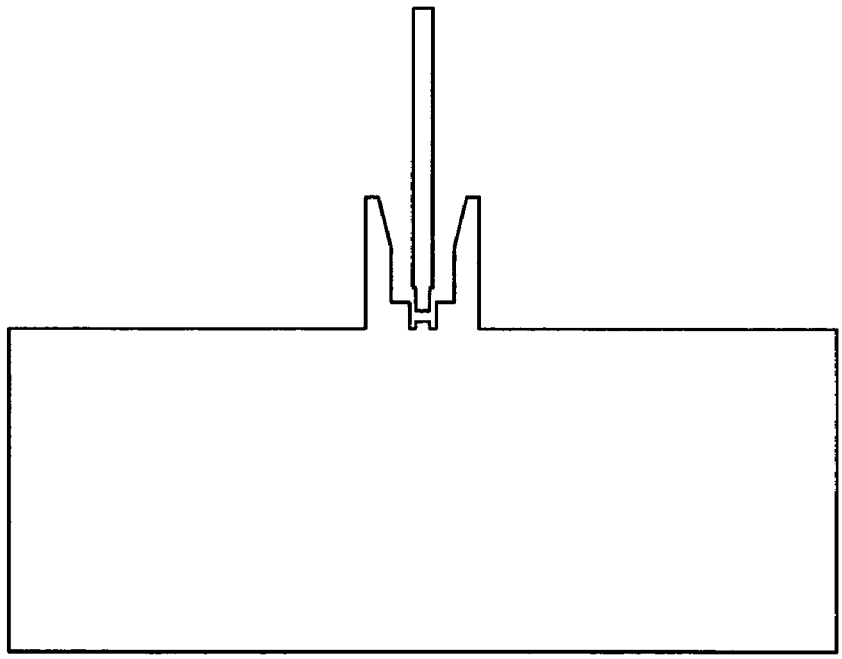
FIG. 15: shows a modification of the embodiment of FIGS. 12 and 13.
Figure 16:
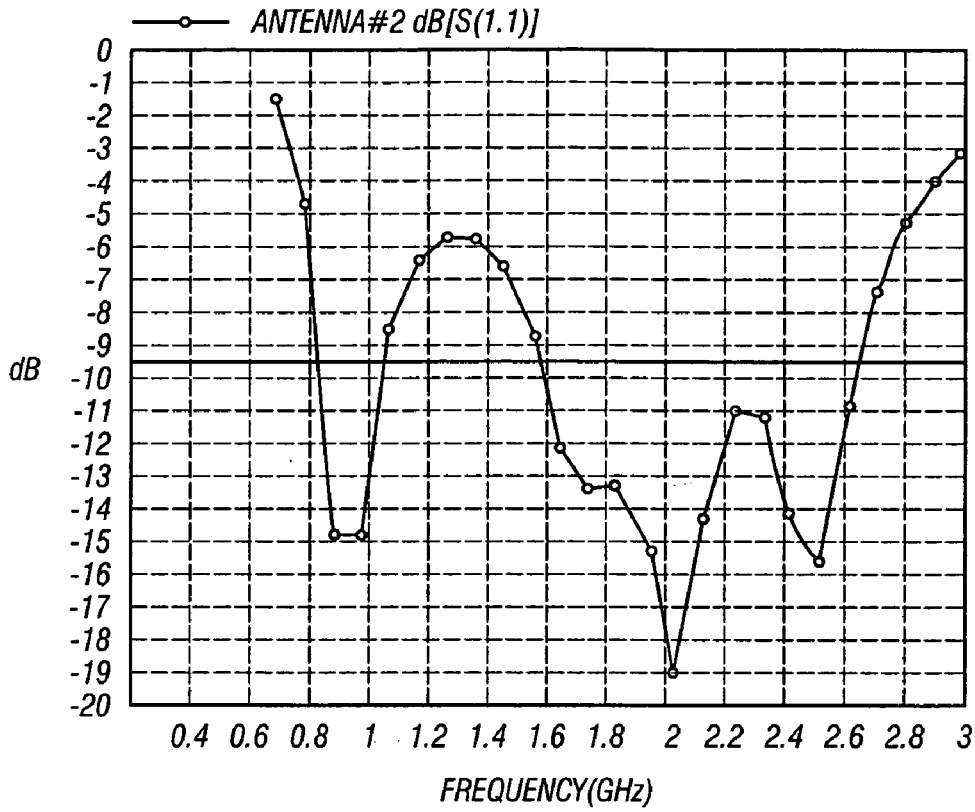
FIG. 16: shows the return loss for the modified antenna of FIG. 15.

FIG. 15 shows a variation of the antenna structure of FIGS. 12 and 13, in which the side recesses have been omitted. In this variant, the dielectric substrate thickness was 8/10 mm and the height of the monopole, above the ground plane, was 65 mm. The numerical results obtained for the return loss (S11) coefficient of this device (referenced to a 50 ohms characteristic impedance) are shown in FIG. 16. It can be seen that this modification still provides adequate performance in the desired frequency bands.

Figure 17:
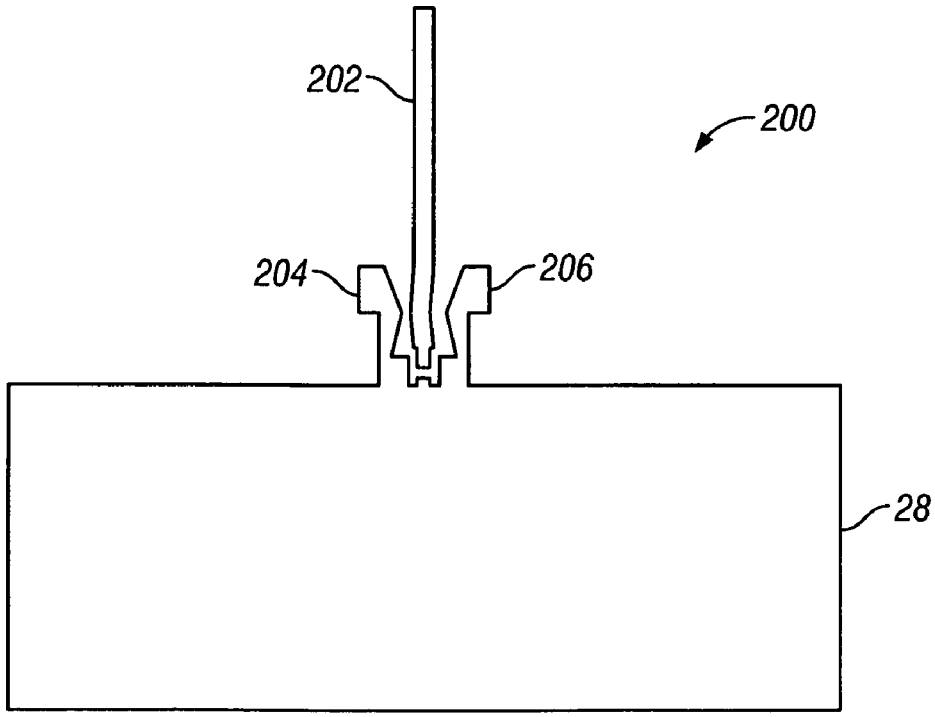
FIGS. 17 and 18: show another embodiment of wide band antenna assembly including exemplary geometrical parameters.
Figure 18:
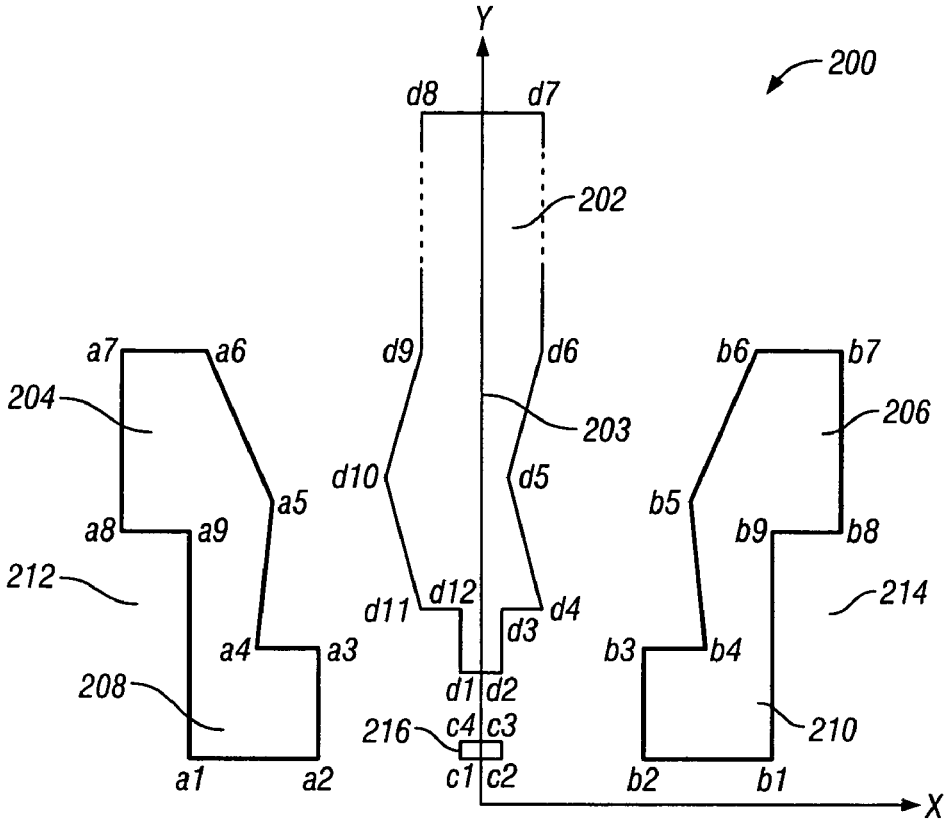

Referring now to FIGS. 17 and 18, another embodiment of wide band monopole antenna structure 200 is shown. In this embodiment, the dielectric substrate 28 thickness is 8/10 mm and the height of the monopole 202, above the ground plane, is 65 mm.

The monopole 202 has a meandering shape at its lower extent, which could be described as a shallow zigzag 203 (see FIG. 18). Each of the grounded elements 204 and 206 is provided with two interior surfaces extending away from the monopole 202 with an apex substantially at the apex of the zigzag 203. The elements 204 and 206 are also provided with feet 208, 210 facing the monopole. The outer face of each element 204, 206 is provided with a recess 212, 214 extending to the base thereof.

A grounded base element 216 is provided spaced from and below the monopole 202 and located between the feet 208, 210 of the elements 204, 206.

FIG. 18 also shows the preferred dimensions of this antenna structure.

Figure 19:
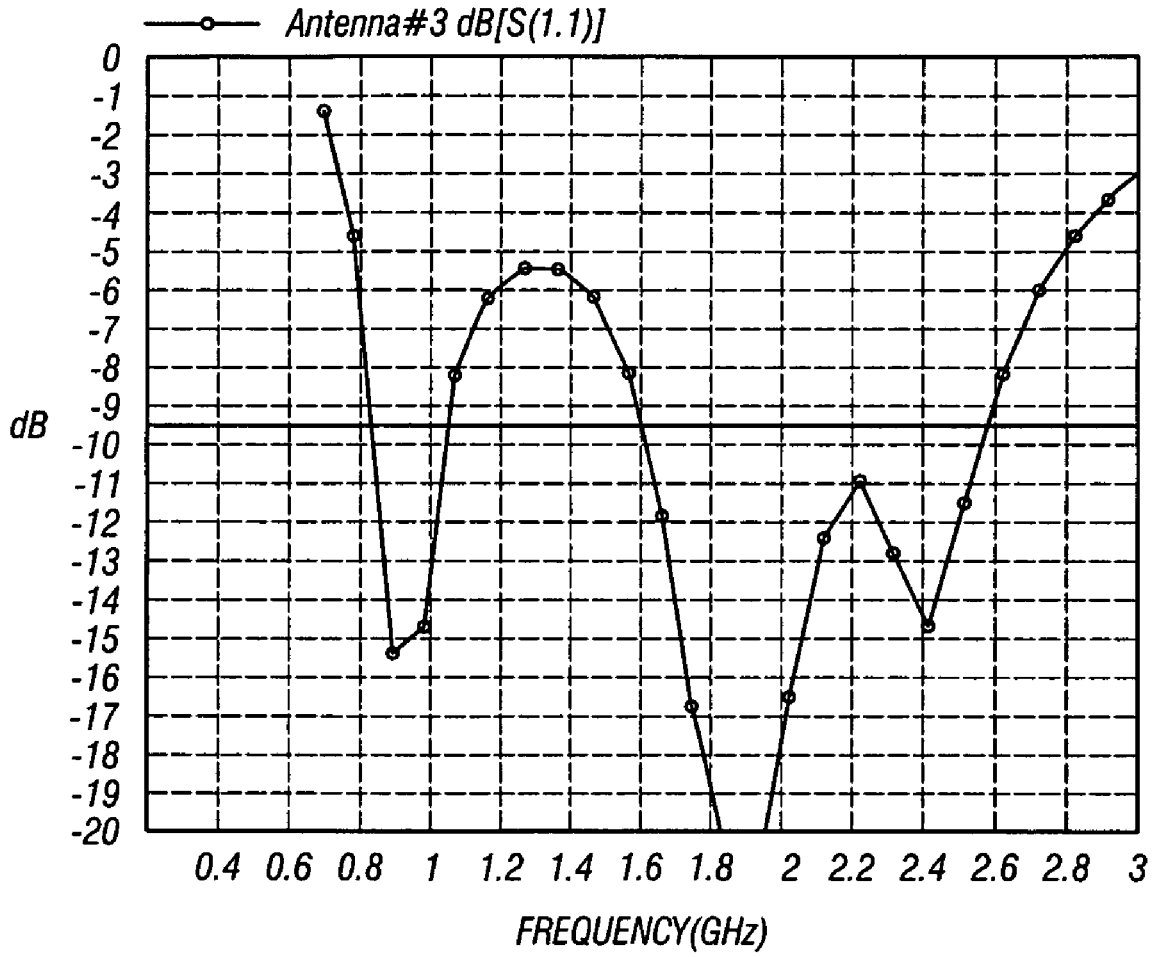
FIG. 19: shows a graph of the numerical results for return loss for the embodiment of the antenna shown in FIGS. 17 and 18.

The performance characteristics of the antenna of FIGS. 17 and 18 are shown in the graph of FIG. 19. It can be seen that this antenna also provides good characteristics in the three bands of interest. Variation of the angled surfaces of the parasitic elements 204, 206, of the zigzag portion 203 of the monopole 202 and of the recesses 212 and 214 will vary the shape of the resonance peaks for the antenna 100, thus enabling adaptation to the particular communication standard desired within the wide band of the antenna. Surprisingly, it has been found that the characteristics of the antenna can be adjusted by altering the specific geometry of the monopole element including the asymmetric lower portion along with the complimentary shape of the jaws or secondary parasitic elements (for example see 204 and 206 in FIG. 17). It is believed that this is the result of resonant interactions between the monopole and the jaws at the various drive frequencies whereby at each of the desired operating frequencies or operating frequency bands, there is relatively little interference caused by the existence of a neighbouring conducting element also being driven at the specified frequency. This allows relatively sensitive adjustment of the return loss curve shape over the varying frequency bands which thus allows the operating characteristics of the antenna to be tuned to the desired level for the different services which the antenna is to access.

In addition, the design parameters of the device, such as size and angle of inclination of the sleeve, can be adjusted in order to adjust the operating characteristics of the antenna, for example to adjust its operating frequency band. It is possible, with such adjustments, to avoid the use of radio frequency filters to filter out undesired frequency bands.

FIGS. 20 to 23 show another version of a wide band antenna structure having features which either alone or in combination with the antennae described above produces superior impedance matching over a wider frequency range. In accordance with this aspect of the invention, there is provided a conductive element or "patch" on the reverse (dielectric) side of the substrate which functions as the drive element for the antenna.

The conductive element in one embodiment described below is 15 mm×15 mm. This element provides important operational advantages, such that a broad-band antenna producing such results can also be designed using simply the conductive element, in one embodiment a patch on the reverse side of the substrate, and a single straight sleeve next to the monopole element.

As with the above-described embodiments, these versions can also be produced as single plane devices for incorporation into portable devices and can also be produced on standard low cost glass epoxy substrates with negligible loss of performance. They can also have the benefits of low cost, low weight, portability, ease of implementation, mechanical rigidity and, above all, wide band of operation.

Figure 20:
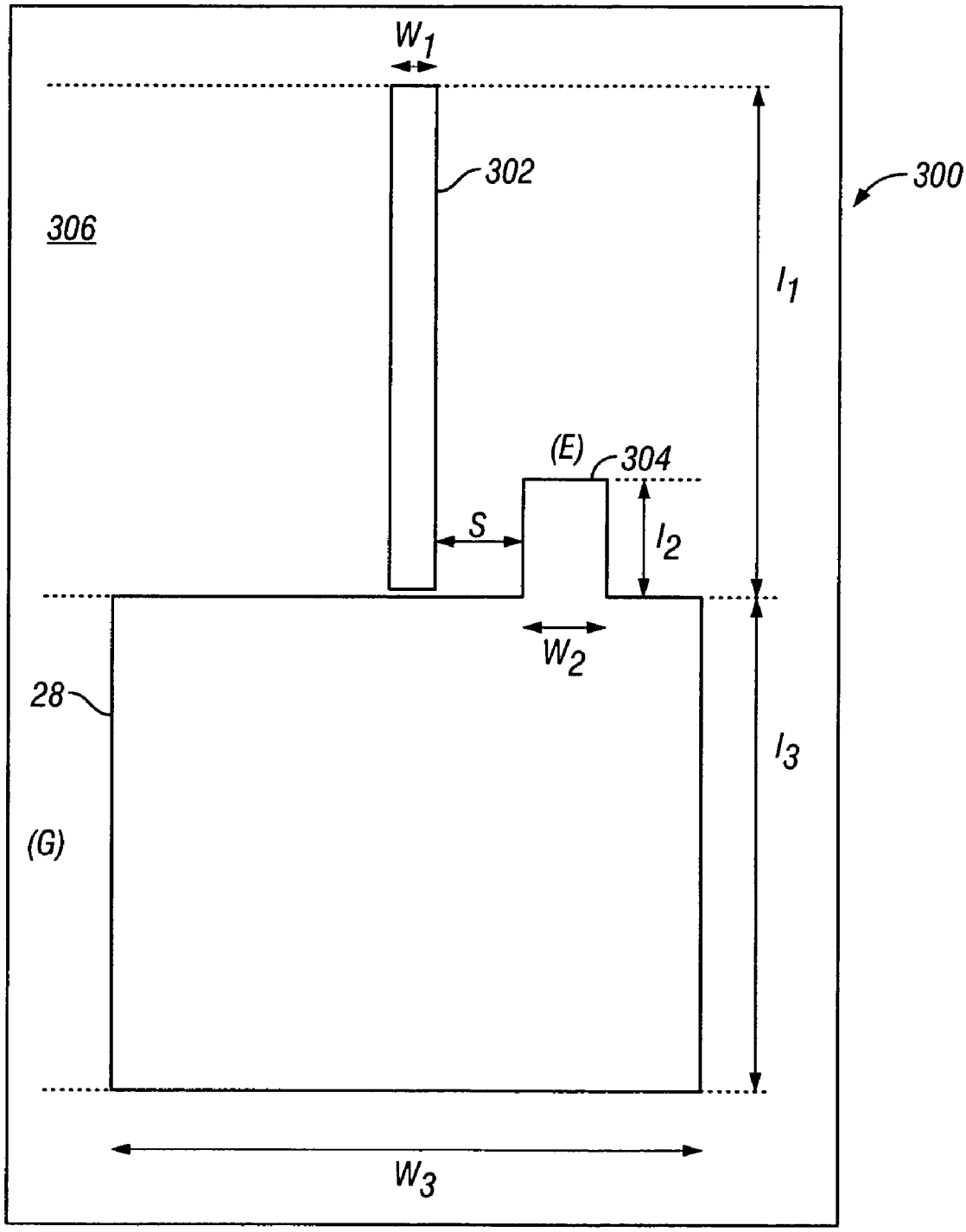
FIG. 20: shows a copper-side view of a further embodiment of a strip-based wide band monopole antenna structure.
Figure 21:
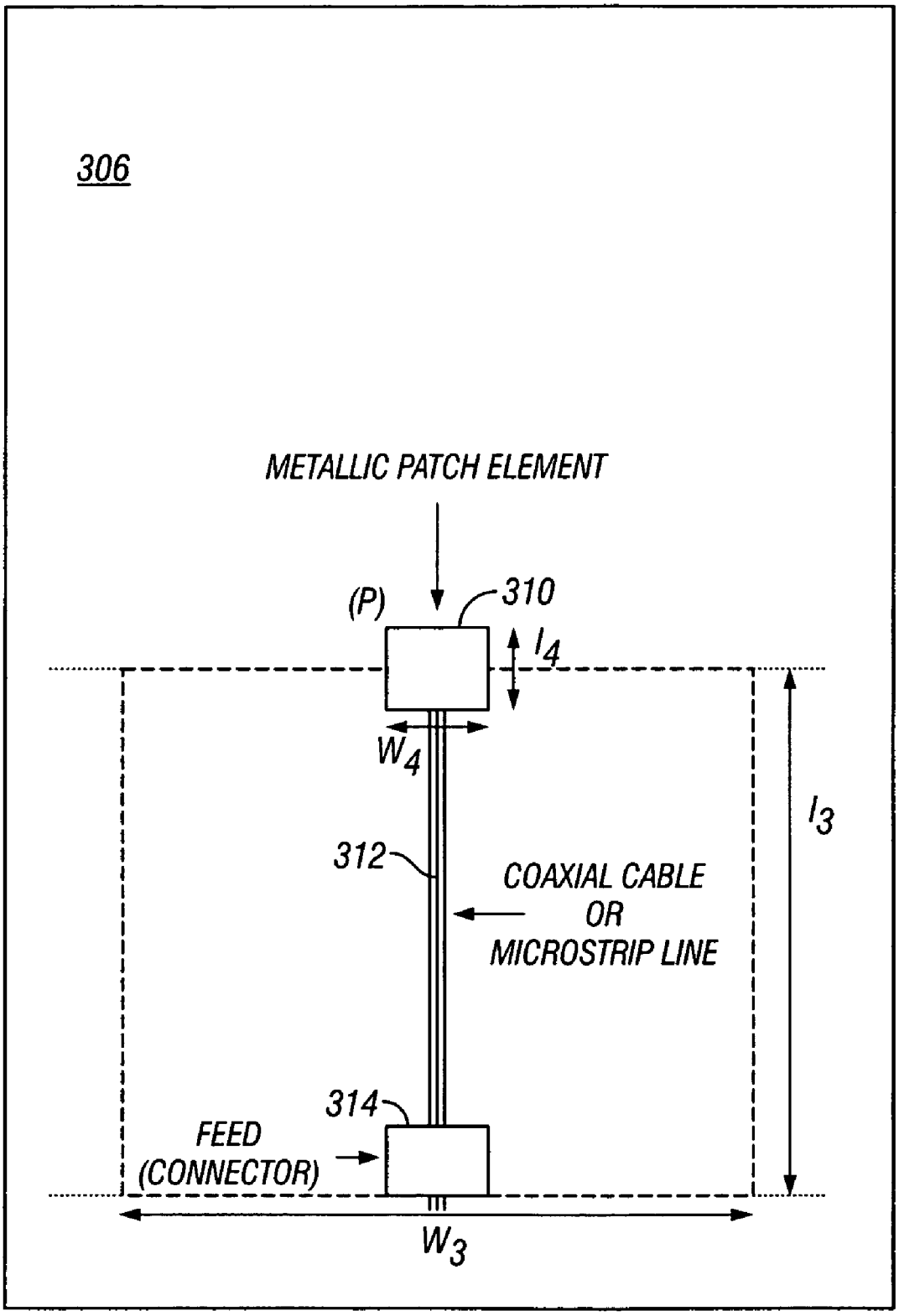
FIG. 21: shows a substrate-side view of an embodiment of a metallic patch element drive point for use with the antenna structure of FIG. 20.

Referring to FIGS. 20 and 21 an embodiment of the novel antenna structure 300 is shown. This is in the form of a metallic strip-based monopole antenna element 302 located over the reference ground plane 28. In a preliminary embodiment, the antenna structure consisting solely of the monopole element 302 exhibits a dual-band mode of operation. When a metallic grounded element or stub 304 is included extending from the ground plane 28 alongside the monopole element 302, the antenna exhibits a multi-band or broad-band mode of operation. As before with this type of antenna structure, the ground plane 28, monopole 302 and ground element 304 are located on one side of a dielectric substrate. As can be seen in FIG. 21 (with the ground plane 28 shown in dotted outline), the patch drive element is located on the other side of the substrate 308. This is connected to a feed connector 314 by means of a coaxial cable or microstrip line 312. FIG. 21 shows the metallic patch element 310 extending beyond the top extremity of the ground plane 28 and, may in practice overlap part of the lower portion of the monopole 302 and grounded element or stub 304.

For the embodiment shown in FIGS. 20 and 21, the preferred dimensions are given in Table 4. The top horizontal edge of the patch (on the reverse side of the substrate) is located 2 mm below with respect to the top horizontal edge of the ground plane. These parameters have been found to be particularly suitable for broad-band behaviour in the frequency range 800–2600 MHz and enhances the bandwidth in the region of 2500 MHz.

TABLE 4

| Device Parameter | Dimension (mm) |
|---|---|
| L1 | 64 |
| W1 | 6 |
| L2 | 21 |
| W2 | 15 |
| L3 | 100 |
| W3 | 100 |
| L4 | 18 |
| W4 | 18 |
| S | 1 |
| L5 | 4 |
| W5 | 38 |

The behaviour of the antenna has surprisingly found to depend significantly on the geometry and position of the patch 310. However, the antenna will still function in broadband mode without it, so long as the antenna is designed with consideration given to the features and parameters discussed above.

Standard epoxy glass material can be employed for the dielectric substrate 306.

Figure 22:
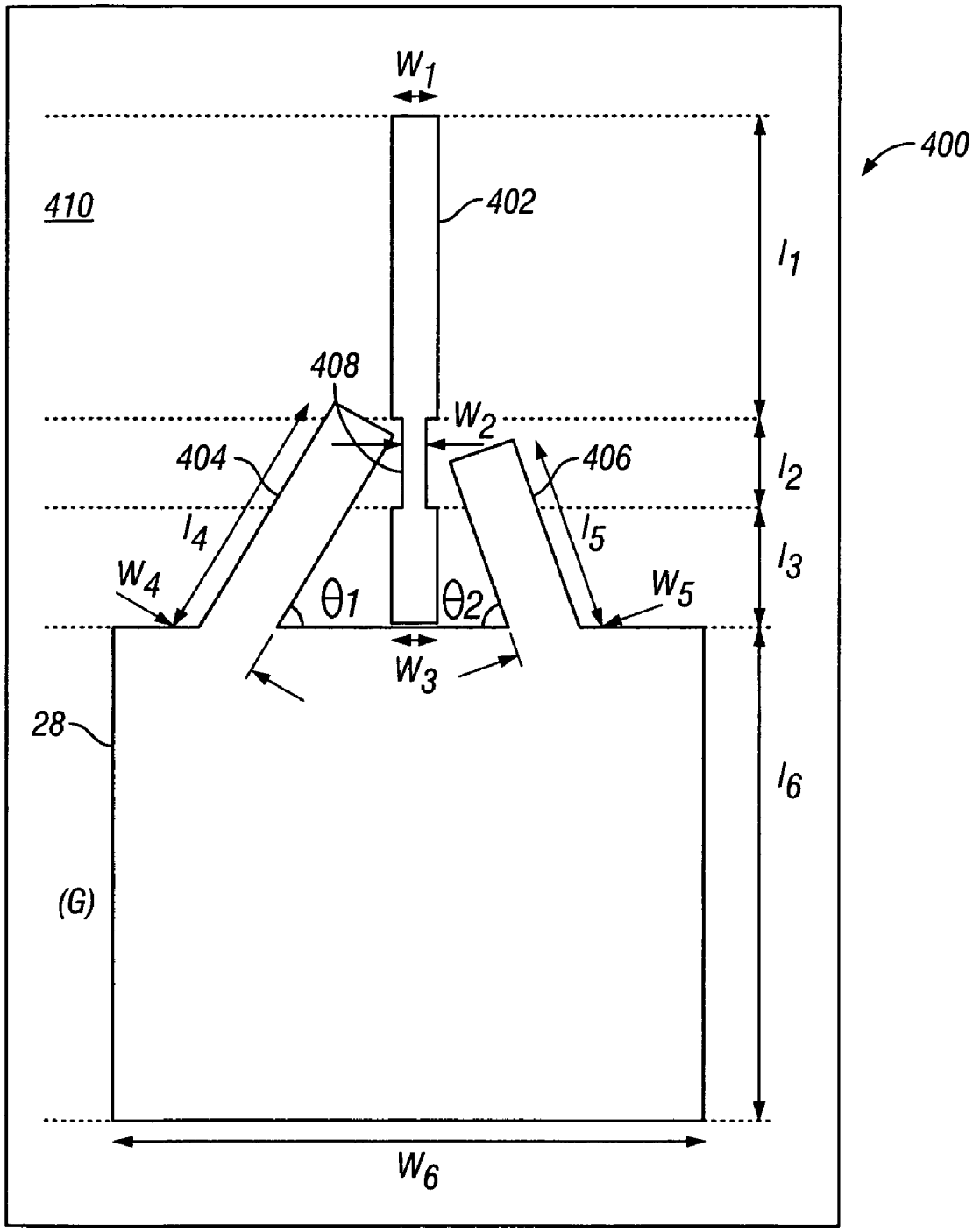
FIG. 22: shows a further embodiment of antenna structure for use with the drive point patch of FIG. 21.
Figure 23:
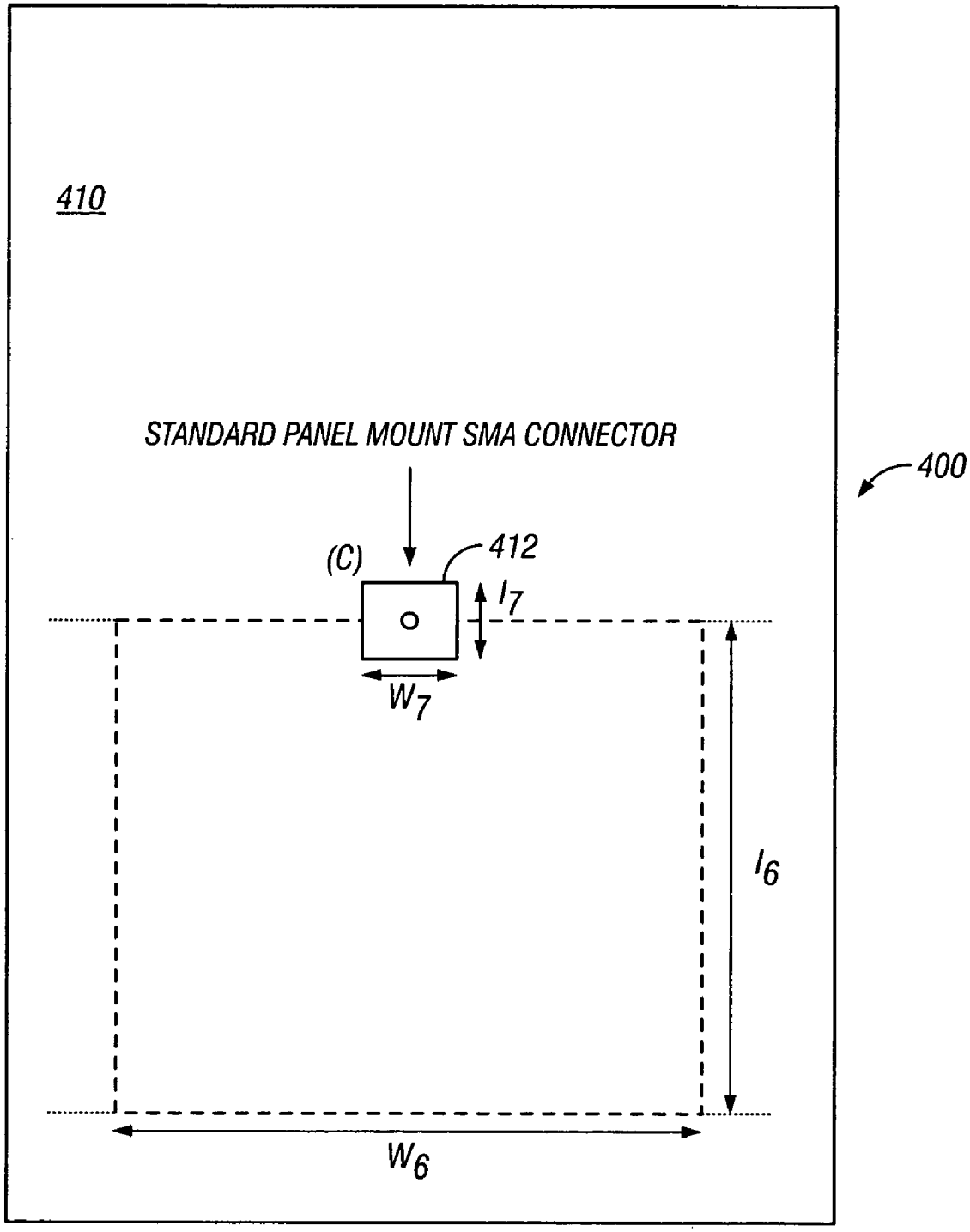
FIG. 23: shows the position of the drive point connection on the substrate side for use with the metal patch embodiment of the antenna structures of FIGS. 20 to 22.

Referring now to FIGS. 22 and 23, there is shown another embodiment of antenna structure 400. This embodiment uses a unique approach to the sleeve-monopole antenna configuration in which the sleeves are now considered independently as parasitic elements. Within specified constraints, the geometry of the parasitic elements providing significant additional degrees of freedom in the design of the antenna. Since the length and the spacing between the sleeve and the monopole greatly influence the return loss of the antenna, these two parameters can be considered simultaneously if the sleeve is inclined into an inverted V-shape as shown in FIG. 22.

More specifically, the antenna structure 400 in FIG. 22 incorporates a monopole element 402 located substantially at the mid point of one end of a planar the ground plane 28. Two grounded elements or stubs 404, 406 extend from the ground plane 28 towards the monopole 402 and angles 1 and 2 respectively to form an inverted V-shape. As is seen from the figure, the geometry of the stubs is asymmetric; in particular, the element 404 is longer than the element 406. However, these dimensions and the angles of the elements 404, 406 can be varied to alter the operating characteristics of the antenna.

Referring to FIG. 22, the monopole 402 has a narrow 'waist' portion 408 located proximate the tips of the grounded elements 404, 406. Again, the geometry of this portion in conjunction with the stub design provides a set of variable, sensitive parameters which affect the characteristics of the antenna as a whole.

The ground plan 28, monopole 402 and grounded elements 404, 406 are, as before, formed on one side of a standard dielectric substrate 410. Referring to FIG. 23, the reverse side of the substrate 410 may include a standard panel mount SMA connector 412 located immediately behind the base of the monopole 402 and which is used directly at the feed-point of the monopole antenna. It's position is appropriately adjusted to provide the desired broad band characteristic. The panel mount connector 412 is of important in this embodiment of antenna and forms an integral part of the device. It is thought that the panel mount connector functions in a manner similar to the conducting patch shown in FIG. 21 and described above. To this end, a patch or panel mount drive point as shown in FIGS. 21 and 23 produces desirable broadband attributes when used in conjunction with the antenna of FIG. 22.

In conjunction with this reverse-side patch element, by appropriately adjusting the two parasitic elements 404, 406 (the inverted-V shape), either multiple-band or broad-band operation can be achieved. For example, a broad-band antenna covering the whole of the desired frequency band (i.e. GSM, GPS, DCS, PCS, UMTS, IEEE 802.11b and Bluetooth) was successfully designed using the values of the parameters given in Table 5

TABLE 5

| Device Parameter | Dimension (mm) (or [degrees] where not applicable) |
|---|---|
| L1 | 47 |
| W1 | 7 |
| L2 | 6 |
| W2 | 3 |
| L3 | 13 |
| W3 | 6 |
| L4 | 27 |
| W4 | 11 |
| L5 | 21 |
| W5 | 11 |
| L6 | 100 |
| W6 | 100 |
| L7 | 12 |
| W7 | 12 |
| 1 | 70 |
| 2 | 78 |
| L8 | 6 |
| W8 | 42 |

Figure 24:
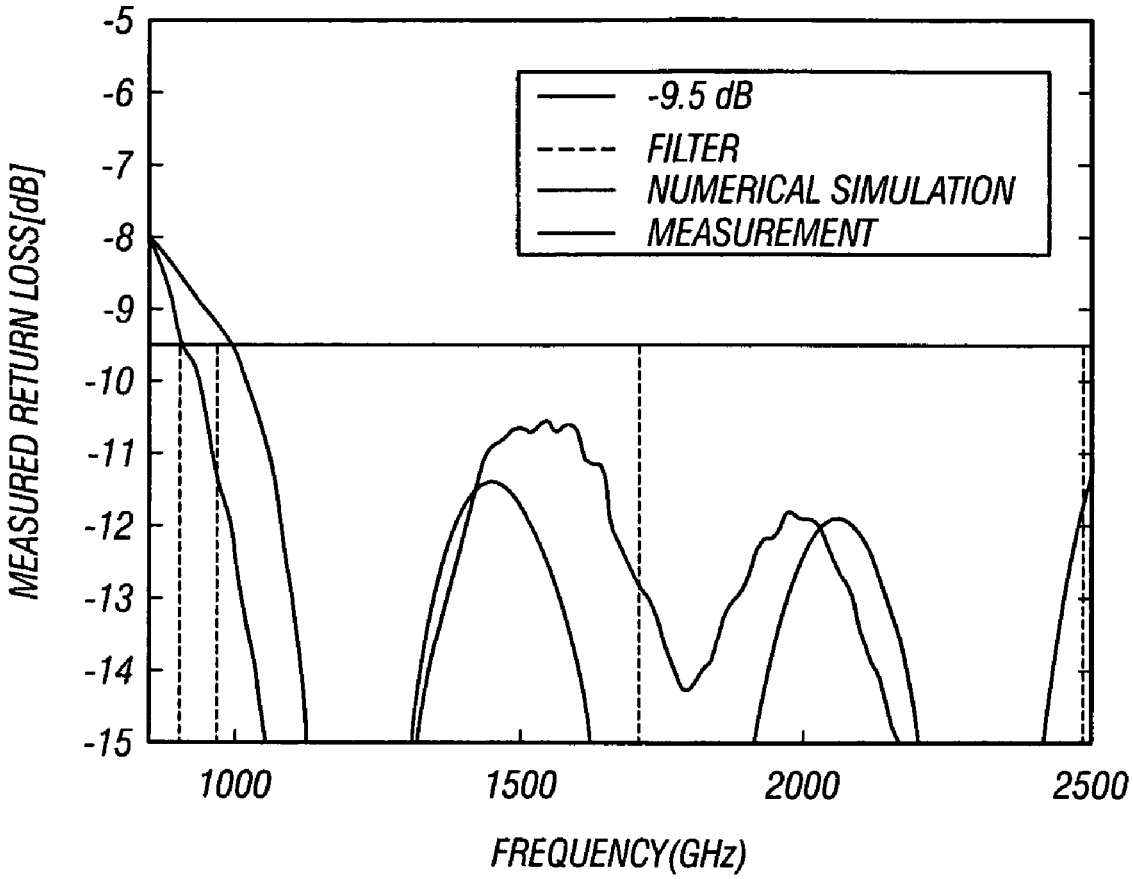
FIG. 24: is a graph showing a numerical simulation and experimental measurement of the return loss of the antenna structure of FIGS. 22 and 23.

FIG. 24 is a graph showing the return loss measured with this antenna. As can be seen, this antenna structure can be made to operate over a wide frequency range. Further, although a GPS antenna usually requires circular polarisation, this antenna provided a good signal level when used in conjunction with a GPS receiver.

Figure 25:
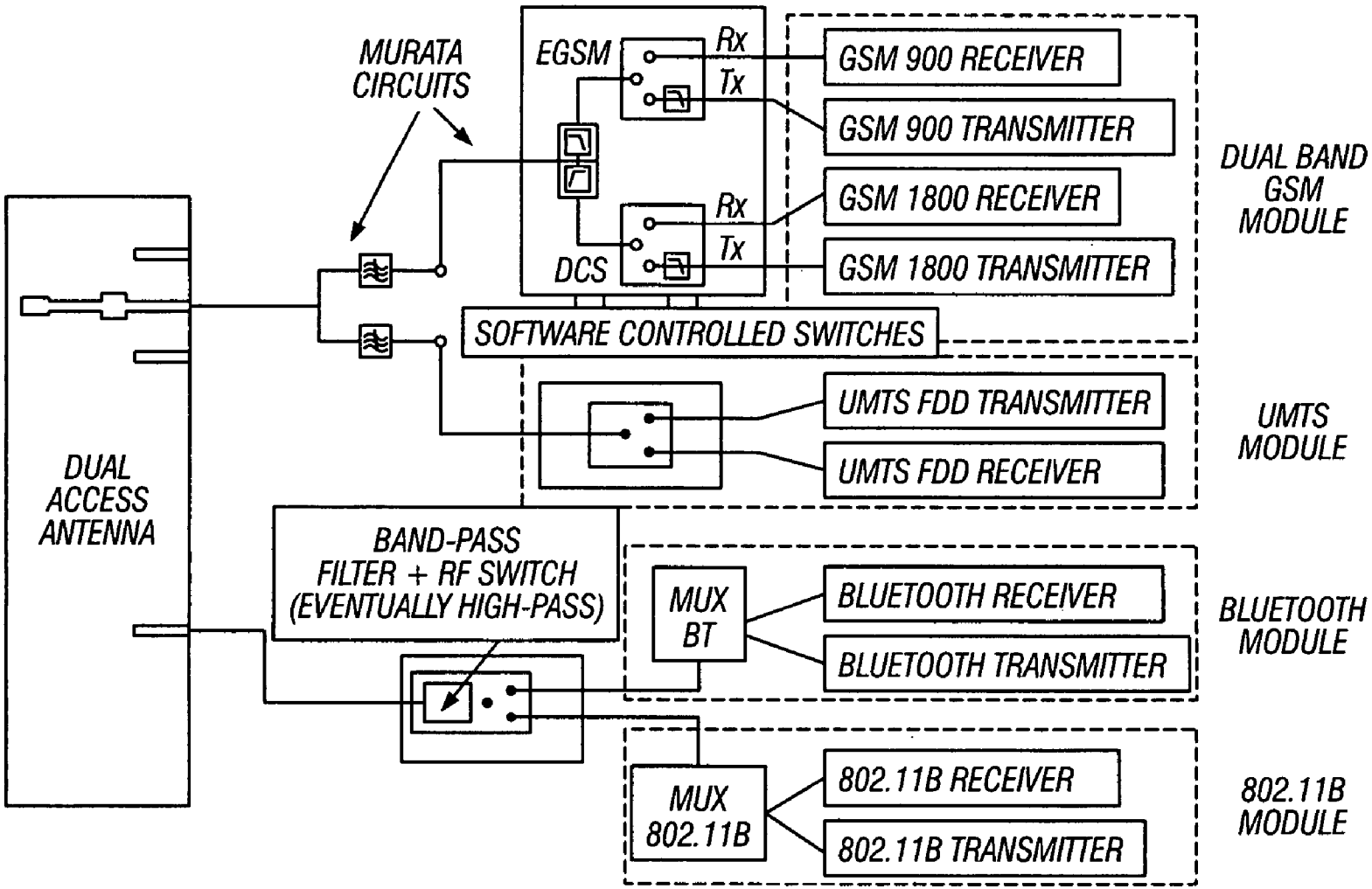
FIG. 25: is an embodiment of a drive circuit for use with the dual-access antennae assemblies described herein.

As noted above, various types of driving circuit may be suitable for use with the antennas described above. To this end, an embodiment of switching circuit for the dual-access antennae assemblies described above is shown in FIG. 24. This embodiment provides a permanent watch on the 2.45 GHz band and scans between the other various cellular systems. FIG. 25 shows the circuit diagram and the possible connections to one of the embodiments of the dual access antennae disclosed herein.

The elements forming this circuit are available in the art and will be familiar to one skilled in the relevant technical field. Therefore, for brevity, they will not be described in detail. In summary, they include a mix of standard SMT commercially available microcircuits and software designed to switch and control every active circuit element depending upon the radio service being used in the application.

Figure 27:
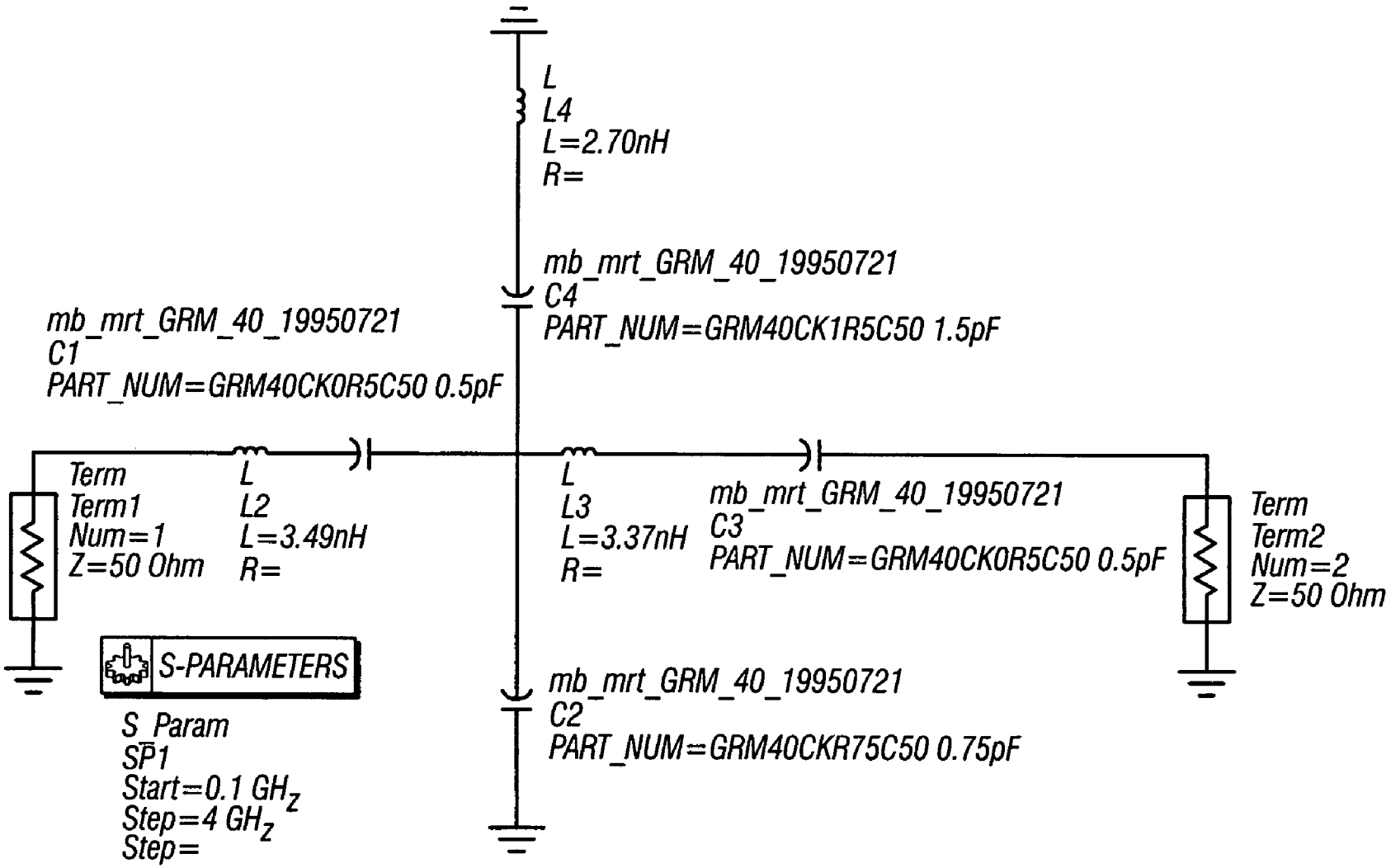
FIG. 27: is an embodiment of circuit for the single access antennae assemblies disclosed herein.

Worthy of note is a preferred form of the high pass filter for the 2.45 GHz band, shown in FIG. 27. The values of the various components correspond to a set of preferred values.

Figure 26:
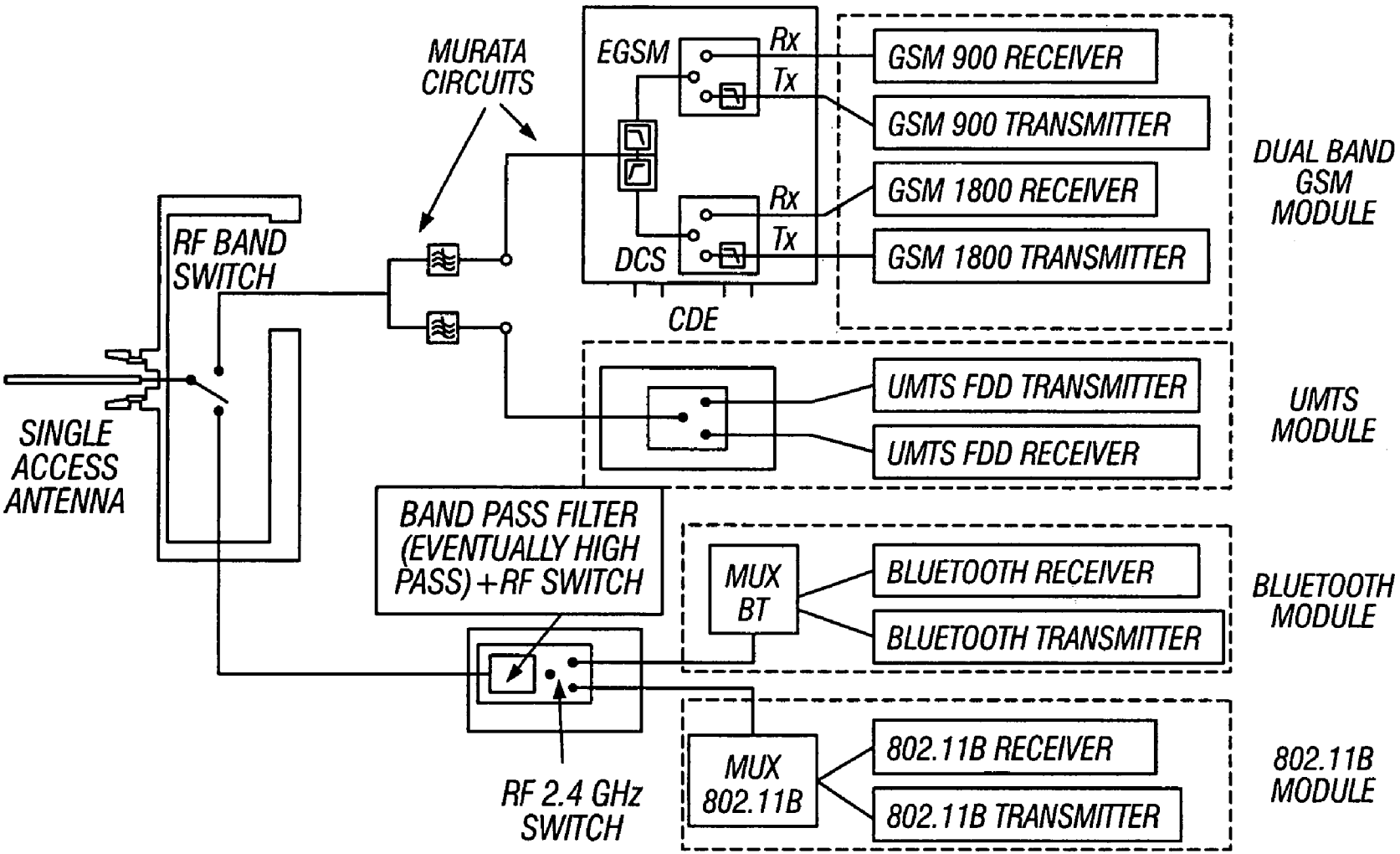
FIG. 26: shows an embodiment of high pass filter for use in the circuit of FIG. 25 or 27.

FIG. 26 illustrates an embodiment of switching circuit for the single access antennae systems disclosed herein. This circuit is provided with one additional wide band switch with respect to the dual access circuit of FIG. 25. It is envisaged that this circuit will be set switched to the 2.45 GHz band for Bluetooth or IEEE 802.11b services. These are likely to be the normally required services, however the system may include a user activated option to switch to the other bands as and when necessary.

In summary, the invention presents embodiments of a novel antenna arrangement which provides wide band performance and is of a configuration embodying design parameters which can be selectively adjusted to shape the return loss curve to most closely approximate the desired return loss for a particular spectrum of service bands. These antennae are particularly useful in small, constrained form factors embodied by devices such as PDAs, laptops and other portable devices.

Although the invention has been described by way of example and with reference to particular embodiments it is to be understood that modification and/or improvements may be made without departing from the scope of the appended claims.

Where in the foregoing description reference has been made to integers or elements having known equivalents, then such equivalents are herein incorporated as if individually set forth.

The invention claimed is:

1. A planar antenna assembly supported on a substrate, said antenna including a monopole element extending from the substrate, at least one grounded parasitic element located proximate the monopole element and extending from the substrate, wherein each grounded parasitic element is grounded to a planar ground plane and incorporates a conductive profile shaped so that the separation between the parasitic element and the monopole adjacent it, varies along the length of the parasitic element.

2. An assembly as claimed in claim 1 wherein the separation between the monopole and the parasitic element is provided by a stepped or angled edge on the or each grounded parasitic element, wherein the profile faces and extends away from monopole element.

3. An assembly according to claim 1, including two grounded parasitic elements located on opposite sides of the monopole element.

4. An assembly according to claim 1, wherein each grounded parasitic element includes a foot extending towards a base part of the monopole element which is adjacent the ground plane.

5. An assembly according to claim 4, wherein the base part of the monopole element is of reduced width compared to the remainder thereof.

6. An assembly according to claim 1, wherein each grounded element includes a recess in an outer edge thereof.

7. An assembly according to claim 5, wherein each recess has an upper wall proximate an end of the conductive profile.

8. An assembly according to claim 6, wherein each recess extends to a base of the grounded element.

9. An assembly according to claim 1, wherein each conductive profile includes two stepped or angled surfaces extending away from the monopole element, with an apex between the two stepped or angled surfaces pointing towards the monopole element.

10. An assembly according to claim 9, wherein a lower portion of the monopole element is of meandering form.

11. An assembly according to claim 10, wherein the meandering form provides an apex located proximate the apex of the two stepped or angled surfaces of the grounded element.

12. An assembly according to claim 1, wherein the monopole element is tuned to operate in a frequency band of substantially 880 MHz to 2,300 MHz.

13. An assembly according to claim 1, wherein the monopole element is tuned to operate in the GSM to UMTS bands.

14. An assembly according to claim 1, wherein the assembly is substantially flat.

15. An assembly as claimed in claim 1 including a stub located between the bottom end of the monopole and the ground plane.

16. An assembly according to claim 1, including switching means operable to switch between a plurality of subbands within the operating band of the monopole element.

17. An assembly according to claim 16, wherein the switching means is operable to provide substantially continuous operation in a wireless networking band and selective operation in other wireless bands.

18. A computing or information device including an antenna assembly as claimed in claim 1.

* * * * *